US009430997B2

(12) United States Patent
Hardi et al.

(10) Patent No.: US 9,430,997 B2
(45) Date of Patent: Aug. 30, 2016

(54) INTERACTIVE INSTRUMENTS AND OTHER STRIKING OBJECTS

(71) Applicant: Muzik LLC, Miami Beach, FL (US)

(72) Inventors: Jason Hardi, Miami Beach, FL (US); Eric Gregory White, Tinton Falls, NJ (US)

(73) Assignee: MUZIK LLC, Miami Beach, FL (US)

( * ) Notice: Subject to any disclaimer, the term of this patent is extended or adjusted under 35 U.S.C. 154(b) by 0 days.

(21) Appl. No.: 14/700,899

(22) Filed: Apr. 30, 2015

(65) Prior Publication Data

US 2016/0203806 A1 Jul. 14, 2016

Related U.S. Application Data

(60) Provisional application No. 62/101,230, filed on Jan. 8, 2015.

(51) Int. Cl.

| | |
|---|---|
| ***G10H 1/18*** | (2006.01) |
| ***G10H 1/00*** | (2006.01) |
| ***G10D 13/00*** | (2006.01) |

(52) U.S. Cl.
CPC ..... *G10H 1/18* (2013.01); *G10D 13/003* (2013.01); *G10H 1/0008* (2013.01)

(58) Field of Classification Search
CPC ..... G10H 1/32
USPC ..... 84/615, 653
See application file for complete search history.

(56) References Cited

U.S. PATENT DOCUMENTS

| | | | | | |
|---|---|---|---|---|---|
| 3,592,097 | A * | 7/1971 | Friede | G10D 13/06 | 84/402 |
| 4,106,079 | A * | 8/1978 | Drury | G10D 13/003 | 362/102 |
| 4,226,163 | A * | 10/1980 | Welcomer | G10D 13/003 | 362/102 |
| 4,722,035 | A * | 1/1988 | Rapisarda | G10D 13/003 | 362/109 |
| 4,904,222 | A * | 2/1990 | Gastgeb | A63H 5/00 | 310/331 |
| 5,062,341 | A * | 11/1991 | Reiling | G10H 1/34 | 84/702 |
| 5,157,213 | A * | 10/1992 | Kashio | G10H 1/34 | 84/622 |
| 5,177,311 | A * | 1/1993 | Suzuki | G10H 1/00 | 84/600 |

(Continued)

*Primary Examiner* — David Warren
(74) *Attorney, Agent, or Firm* — Perkins Coie LLP

(57) ABSTRACT

Systems, methods, and devices for providing interactive striking objects (e.g., drumsticks) and performing actions in response to striking motions of the striking objects are disclosed. In some embodiments, the systems and methods provide an interactive drumstick, which includes a lighting display located at a tip portion of the interactive drumstick, a motion detector contained at least partially within the drumstick, a processor and memory contained at least partially within the drumstick, and an interactive system stored within the memory of the drumstick. The interactive system includes a striking motion module that determines striking motions of the drumstick with respect to a virtual percussion instrument based on accessing information measured by the motion detector, and a display module that causes the lighting display to present a certain type of illumination based on the striking motions determined by the striking motion module.

24 Claims, 13 Drawing Sheets

(56) References Cited

U.S. PATENT DOCUMENTS 5,280,743 A * 1/1994 Abel ..... G10D 13/003 362/102
5,350,881 A * 9/1994 Kashio ..... G10H 1/34 84/622
6,423,891 B1 * 7/2002 Zengerle ..... G10D 13/003 84/422.4
6,479,737 B1 * 11/2002 Lebeda ..... G10D 13/003 84/422.4
7,687,700 B1 * 3/2010 Torres ..... G10D 13/003 362/34
2006/0107819 A1 * 5/2006 Salter ..... G09B 5/06 84/470 R
2006/0283233 A1 * 12/2006 Cordani ..... G10H 3/12 73/12.01
2009/0019986 A1 * 1/2009 Simpkins, III ..... G10D 13/003 84/422.4
2010/0261513 A1 * 10/2010 Izen ..... G10H 3/146 463/7
2011/0017046 A1 * 1/2011 Stockli ..... G10D 13/003 84/422.4
2011/0030533 A1 * 2/2011 Piccionelli ..... G10H 3/146 84/422.4
2011/0162512 A1 * 7/2011 White ..... G10D 13/003 84/422.4
2011/0239847 A1 * 10/2011 Small ..... G10H 1/0083 84/723
2012/0247308 A1 * 10/2012 Tsai ..... G06F 3/0421 84/658
2013/0047823 A1 * 2/2013 Tabata ..... G10H 1/0008 84/639
2013/0113396 A1 * 5/2013 Uehara ..... G09F 13/34 315/312
2013/0152768 A1 * 6/2013 Rapp ..... G10H 3/125 84/634
2013/0228062 A1 * 9/2013 Tabata ..... G10H 1/0008 84/602
2013/0239780 A1 * 9/2013 Tabata ..... G10H 1/0008 84/602
2013/0239781 A1 * 9/2013 Yoshihama ..... G10H 7/00 84/609
2013/0239782 A1 * 9/2013 Yoshihama ..... G10H 7/00 84/609
2013/0239783 A1 * 9/2013 Tabata ..... G10H 1/0008 84/609
2013/0239784 A1 * 9/2013 Tabata ..... G10H 1/0008 84/609
2013/0239785 A1 * 9/2013 Tabata ..... G10H 1/0008 84/609
2013/0255476 A1 * 10/2013 Sakurai ..... G10H 5/00 84/723
2013/0262021 A1 * 10/2013 Sakurai ..... G10H 1/32 702/141
2013/0262024 A1 * 10/2013 Sakurai ..... G01B 7/14 702/150
2015/0143976 A1 * 5/2015 Katto ..... A63F 13/211 84/602

* cited by examiner

INTERACTIVE INSTRUMENTS AND OTHER STRIKING OBJECTS

CROSS REFERENCE TO RELATED APPLICATIONS

This application claims priority to U.S. Provisional Patent Application No. 62/101,230, filed on Jan. 8, 2015, entitled INTERACTIVE MOTION DETECTING INSTRUMENT, which is hereby incorporated by reference in its entirety.

BACKGROUND

People create music by playing instruments. For example, a musician may strike a snare drum with a drumstick to make a certain sound, tap a cymbal with another drumstick to make a different sound, and hit a base drum with a mallet attached to a foot pedal to make another sound.

People also use devices and systems that represent, or mimic, instruments for creating music, for interacting with video games, or for performing other actions. For example, there are devices that provide a user with an experience of playing a piano, striking a drum, hitting a tennis ball, boxing an opponent, and so on, without requiring the user to have a piano, own a drum set, go to a tennis court, or find an opponent to box. However, typical devices and systems may have drawbacks in providing an effective and realistic experience to a user, because they inadequately mimic the real-life experience they attempt to provide. For example, imprecise timing of user motions and imprecise mapping of user motion location are common in virtual user experiences.

These and other problems exist with respect to conventional user interactive systems and devices.

SUMMARY

Example implementations of the present invention are generally related to interactive devices creating an accurate and realistic user experience in a virtual environment. In one example implementation one or more wands used for virtually striking an object are held by a user. A processing module predicts the moment of strike based on the user movement and transmits strike information to a base station in advance of the actual strike in order to overcome latency in the transmission. Additionally, the relative location of the strike with regard to the user is determined and transmitted to pair the user's strike with a preselected virtual object associated with the relative location of the strike to the user.

In another example implementation of the present invention, an interactive drumstick, comprises: a lighting display located at a tip portion of the interactive drumstick; a motion detector contained at least partially within the drumstick; a processor and memory contained at least partially within the drumstick, and an interactive system stored within the memory of the drumstick, the interactive system including: a striking motion module that determines striking motions of the drumstick with respect to a virtual percussion instrument based on accessing information measured by the motion detector; and a display module that causes the lighting display to present a certain type of illumination based on the striking motions determined by the striking motion module.

Example implementations may also include one or more of the following features in any combination: an audio output module that causes an audio presentation device to present sounds to a user associated with the drumstick that are indicative of the drumstick striking one or more virtual percussion instruments; a speaker, and an audio output module that causes the speaker to play sounds that are indicative of the drumstick striking one or more virtual percussion instruments; a striking motion module determines a trajectory of movement of the drumstick based on information measured by the motion detector; a striking motion module determines an acceleration of movement of the drumstick based on information measured by the motion detector; striking motion module determines an orientation in space of the drumstick based on information measured by the motion detector; a display module causes the lighting display to present a certain color of illumination based on the striking motions determined by the striking motion module; a vibration component, and a feedback module that causes the vibration component to vibrate based on the striking motions determined by the striking motion module; and a haptic feedback module.

Yet another example implementation of the present invention includes an interactive wand, comprising: a housing; a feedback device; a motion detector contained at least partially within the housing; a processor and memory contained at least partially within the housing, and an interactive system stored within the memory, the interactive system including: a striking motion module that determines striking motions of the wand with respect to a virtual object based on accessing information measured by the motion detector; and a feedback module that causes the feedback device to perform an action based on the striking motions determined by the striking motion module.

Example implementations of the present invention may include one or more of the following features in any combination: the housing has an elongated shape and is configured to be held in a hand of a user; the housing is configured to be attached to a foot of a user; the feedback device is a lighting display, and wherein the feedback module causes the lighting display to present a certain type of illumination based on the striking motions determined by the striking motion module; the feedback device is a speaker, and wherein the feedback module causes the speaker to play sounds that are indicative of the wand striking one or more virtual objects.

Still further example implementations of the represent invention include a method of generating an audio sequence of sounds, the method comprising: accessing movement information associated with drumsticks or wands measured by a motion detector, the drumsticks or wands performing striking motions with respect to a virtual drum set or other virtual objects; and generating a sound or other indication for every striking motion performed with respect to the virtual drum set or other virtual objects.

The example implementations may include one or more of the following features in any combination: accessing movement information associated with drumsticks or wands measured by a motion detector includes accessing movement information from images captured by one or more image sensors; accessing movement information associated with drumsticks or wands measured by a motion detector includes accessing movement information measured by accelerometers and gyroscopes of the drumsticks or wands; generating a sound for every striking motion performed with respect to the virtual drum set includes, for every striking motion, (1) identifying a virtual drum or virtual cymbal of the virtual drum set that is associated with the striking motion, (2) determining a force of a strike of the virtual drum or virtual cymbal during the striking motion (3) generating a sound that is indicative of a real drum or real cymbal represented by the virtual drum or virtual cymbal and based on the determined force of the strike of the virtual drum or virtual cymbal; generating a feedback indication for every striking motion performed with respect to the virtual objects includes, for every striking motion, (1) identifying a virtual object that is associated with the striking motion, (2) determining a force of a strike of the virtual object during the striking motion (3) generating a sound, visual indication, haptic or vibratory information, or other user feedback that is indicative of a real object represented by the virtual object and based on the determined force of the strike of the virtual object.

Example implementations may still further include one or more of the following features in any combination: the method further comprising a step of causing a mobile device or base station of a user associated with the drumsticks to play the generated audio sequence; the method of claim causes one or more speakers contained by the drumsticks to play the generated audio sequence; the method accesses movement information associated with drumsticks measured by a motion detector includes accessing information associated with a trajectory and acceleration of the drumsticks with respect to the virtual drum set.

In yet another example implementation of the present invention, a system, comprises: a drumstick state module that measures a state of motion of a drumstick relative to a virtual strike location for a virtual strike of a virtual drum to be performed by the drumstick; a strike prediction module that determines a predicted time at which the drumstick arrives at the virtual strike location for the virtual strike of the virtual drum based on the measured state of motion of the drumstick; and an action module that performs an action associated with a drumstick striking a real drum upon commencement of the determined predicted time.

Further example implementations of the present invention may include one or more of the following features in any order: the strike prediction module (1) measures, from the identified state of motion of the drumstick relative to the virtual strike location, a current acceleration and trajectory of the drumstick within three-dimensional space with respect to the virtual strike location of the virtual drum, and (2) determines the predicted time as a time at which a tip portion of the drum stick is expected to arrive at the virtual strike location based on the measured acceleration and trajectory of the drumstick with respect to the virtual strike location; the strike prediction module determines the predicted time as a time at which the predicted state of motion of the drumstick is associated with the drumstick decelerating to approximately zero acceleration proximate to the virtual strike location of the virtual drum; the strike prediction module determines the predicted time as a time at which a trajectory of the drumstick within three-dimensional space with respect to the virtual strike location of the virtual drum is predicted to change from a first direction towards the virtual strike location of the virtual drum to a second direction away from the virtual strike location of the virtual drum; the drumstick state module and the strike prediction module are located within the drumstick, and wherein the action module is located within a mobile application supported by a mobile device associated with a user of the drumstick and the system further comprises a communication module that communicates a message whose contents include information representing the determined predicted time and information representing the identified state of motion of the drumstick from the strike prediction module to the action module; the drumstick state module and the strike prediction module are part of a motion detection device that captures images of the motion of the drumstick, and wherein the action module is located within a mobile application supported by a mobile device associated with a user of the drumstick and the system further comprises a communication module that communicates a message whose contents include information representing the determined predicted time and information representing the identified state of motion of the drumstick from the strike prediction module to the action module; a communication module that communicates a message from the strike prediction module to the action module before a tip portion of the drum stick arrives at the virtual strike location of the virtual drum, the message including information representing the determined predicted time and information representing the identified state of motion of the drumstick; the action module causes an audio presentation device associated with a user of the drumstick to play a sound indicative of the drumstick striking the real drum associated with the virtual drum at the virtual drum location; the action module causes an audio presentation device associated with a user of the drumstick to play a sound that is based on the real drum associated with the virtual drum at the virtual drum location and a measured strike force applied from the drumstick to the virtual drum during the virtual strike.

In still another example implementation of the present invention a method, comprises: measuring a state of motion of a striking object relative to a virtual strike location for a virtual strike of a virtual percussion instrument to be performed by the striking object; determining a predicted time at which the striking object arrives at the virtual strike location for the virtual strike of the virtual percussion instrument based on the measured state of motion of the striking object; and performing an action associated with the striking object striking a real percussion instrument upon commencement of the determined predicted time.

Further example implementations of the present invention may also include the following one or more of the following features in any order: the method determines a predicted time at which the striking object arrives at the virtual strike location for the virtual strike of the virtual percussion instrument based on the measured state of motion of the striking object includes; the method measures, from the identified state of motion of the striking object relative to the virtual strike location, a current acceleration and trajectory of the striking object within three-dimensional space with respect to the virtual strike location of the virtual percussion instrument; and the method determines the predicted time as a time at which a strike portion of the striking object is expected to arrive at the virtual strike location based on the measured acceleration and trajectory of the striking object with respect to the virtual strike location.

Even further example implementations of the present invention may include one or more of the following features in any order: the method determines a predicted time at which the striking object arrives at the virtual strike location for the virtual strike of the virtual percussion instrument based on the measured state of motion of the striking object includes determining the predicted time as a time at which the predicted state of motion of the striking object is associated with the striking object decelerating to approximately zero acceleration when proximate to the virtual strike location of the virtual percussion instrument; the method determines a predicted time at which the striking object arrives at the virtual strike location for the virtual strike of the virtual percussion instrument based on the measured state of motion of the striking object includes determining the predicted time as a time at which a trajectory of the striking object within three-dimensional space with respect to the virtual strike location of the virtual percussion instrument is predicted to change from a first direction towards the virtual strike location of the virtual percussion instrument to a second direction away from the virtual strike location of the virtual percussion instrument; the method performs an action associated with a striking object striking a real percussion instrument upon commencement of the determined predicted time includes causing an audio presentation device associated with a user of the striking object to play a sound indicative of a drumstick striking a drum or cymbal; the method performs an action associated with a striking object striking a real percussion instrument upon commencement of the determined predicted time includes causing an audio presentation device associated with a user of the striking object to play a sound indicative of a foot pedal striking a drum or engaging a cymbal.

And in still another example implementation of the present invention includes a non-transitory computer-readable medium whose contents, when executed by a computing system, cause the computing system to perform operations for generating an audio sequence based on a monitored movement of drumsticks with respect to virtual drum locations, the operations comprising: monitoring movement of the drumsticks relative to the virtual drum locations; determining predicted times of virtual strikes performed by the drumsticks at the virtual drum locations; and generating an audio sequence that includes sounds to be played upon commencement of the determined predicted times of the virtual strikes at the virtual drum locations.

Further example implementations of the present invention may include one or more of the following features in any order: determining predicted times of virtual strikes performed by the drumsticks at the virtual drum locations includes, for each virtual strike performed by a drumstick at a virtual drum location; determining a state of motion of the drumstick relative to the virtual drum location, wherein the state of motion is based on a measured acceleration of the drumstick and a measured trajectory of the drumstick within three-dimensional space with respect to the virtual drum location; and determining a predicted time of a virtual strike performed by the drumstick at the virtual drum location based on the determined state of motion of the drumstick relative to the virtual drum location.

Even further example implementations of the present invention include one or more of the following features in any order: monitoring movement of the drumsticks relative to the virtual drum locations includes measuring movement of the drumsticks using one or more accelerometers or gyroscopes contained within the drumsticks; monitoring movement of the drumsticks relative to the virtual drum locations includes, (1) visually capturing movement of the drumsticks using one or more image sensors, and (2) extracting information associated with acceleration of the drumstick and a trajectory of the drumstick within three-dimensional space from images captures by the one or more image sensors; and generating an audio sequence that includes sounds to be played upon commencement of the determined predicted times of the virtual strikes at the virtual drum locations includes generating, for every virtual strike at a virtual drum location, a sound that is based on a specific virtual drum associated with the virtual drum location and a measured strike force applied from the drumstick to the specific virtual drum during the virtual strike.

Yet a further still example implementation of the present invention includes a method, comprising: measuring a state of motion of a wand relative to a virtual strike location for a virtual strike of a virtual object performed by the striking wand; determining a predicted time at which the wand arrives at the virtual strike location for the virtual strike of the virtual object based on the measured state of motion of the wand; and performing an action associated with the wand striking a real object upon commencement of the determined predicted time; wherein determining a predicted time at which the wand arrives at the virtual strike location for the virtual strike of the virtual object based on the measured state of motion of the wand includes, (1) measuring, from the identified state of motion of the wand relative to the virtual strike location, a current acceleration and trajectory of the wand within three-dimensional space with respect to the virtual strike location of the virtual object, and (2) determining the predicted time as a time at which a strike portion of the wand is expected to arrive at the virtual strike location based on the measured acceleration and trajectory of the wand with respect to the virtual strike location.

Example implementations of the present invention may still further include one or more of the following features in any order: determining a predicted time at which the wand arrives at the virtual strike location for the virtual strike of the virtual object based on the measured state of motion of the wand includes determining the predicted time as a time at which the predicted state of motion of the wand is associated with the wand decelerating to approximately zero acceleration when proximate to the virtual strike location of the virtual object; determining a predicted time at which the wand arrives at the virtual strike location for the virtual strike of the virtual object based on the measured state of motion of the wand includes determining the predicted time as a time at which a trajectory of the wand within three-dimensional space with respect to the virtual strike location of the virtual object is predicted to change from a first direction towards the virtual strike location of the virtual object to a second direction away from the virtual strike location of the virtual object.

And in still another example implementation of the present invention a system, comprises: a percussion object mapping module that maps percussion objects to respective zones of a striking space established around a user performing striking motions with respect to virtual percussion objects within the striking space using striking objects; a motion determination module that determines, for one or more striking motions performed by the user, the zones at which the striking motions occur; and an action module that performs an action based on occurrences of the striking motions within the determined zones. The motion determination module determines a zone at which a striking motion occurs by, (1) identifying a geospatial azimuth position relative to the user within the striking space of the striking object during the striking motion and (2) selecting a zone of the striking space that includes the identified geospatial azimuth position. The motion determination module determines a zone at which a striking motion occurs by, (1) identifying a direction of the striking object during the striking motion, and (2) selecting a zone of the striking space that includes the identified direction. The motion determination module determines a zone at which a striking motion occurs by, (1) identifying a direction of the striking object during the striking motion and an orientation of the striking object within a hand of the user, and (2) selecting a zone of the striking space that includes the identified direction and identified orientation of the striking object within the hand of the user.

Still further example implementations may include one or more of the following features in any order: the action module causes a sound that represents a strike of a percussion object associated with the determined zone to be inserted into an audio sequence of percussive sounds; the action module causes a sound that represents a strike of a percussion object associated with the determined zone to be played by a mobile device associated with the user; the percussion object mapping module maps percussion objects of a drum set to respective zones of the striking space; the percussion object mapping module maps a first set of percussion objects of a drum set to first zones of the striking space established around striking objects held by the user and a second set of percussion objects of the drum set to second zones of the striking space established around striking objects attached to one or more feet of the user; the percussion object mapping module maps percussion objects of a drum set to respective zones of the striking space that are established with respect to azimuth positions of striking objects held by the user; and the percussion object mapping module maps percussion objects of a drum set to respective zones of the striking space that are established with respect to orientations of striking objects held by the user in predetermined directions.

In an additional example implementation of the present invention, a method comprises: mapping one or more percussion objects to respective zones of a striking space established around a user performing striking motions with respect to virtual percussion objects within the striking space using striking objects; determining, for one or more striking motions performed by the user, the zones at which the striking motions occur; and performing an action based on occurrences of the striking motions within the determined zones.

Example implementations of the present invention may include one or more of the following features in any order: the method determines the zones at which the striking motions occur by (1) identifying a geospatial azimuth position relative to the user within the striking space of the striking object during the striking motion and (2) selecting a zone of the striking space that includes the identified geospatial azimuth position; the method determines the zones at which the striking motions occur by determining the zones at which the striking motions occur by (1) identifying a direction of the striking object during the striking motion and (2) selecting a zone of the striking space that includes the identified direction; the method determines the zones at which the striking motions occur by (1) identifying a direction of the striking object during the striking motion and an orientation of the striking object within a hand of the user; and (2) selecting a zone of the striking space that includes the identified direction and identified orientation of the striking object within the hand of the user.

Further example implementations may include one or more of the following features in any order: the method performs an action based on occurrences of the striking motions within the determined zones includes causing a sound that represents a strike of a percussion object associated with the determined zone to be inserted into an audio sequence of percussive sounds; the performs an action based on occurrences of the striking motions within the determined zones includes causing a sound that represents a strike of a percussion object associated with the determined zone to be played by a mobile device associated with the user; the method maps one or more percussion objects to respective zones of a striking space includes mapping percussion objects of a drum set to respective zones of the striking space; and the method maps one or more percussion objects to respective zones of a striking space includes mapping a first set of percussion objects of a drum set to first zones of the striking space established around striking objects held by the user and a second set of percussion objects of the drum set to second zones of the striking space established around striking objects attached to one or more feet of the user; the method maps one or more percussion objects to respective zones of a striking space includes mapping percussion objects of a drum set to respective zones of the striking space that are established with respect to azimuth positions of striking objects held by the user.

And in yet an additional example implementation of the present invention a non-transitory computer-readable medium whose contents, when executed by a computing system, cause the computing system to perform operations for generating an audio sequence, the operations comprising: determining that a user has performed a striking motion within a certain zone of a striking space established around the user; and inserting a sound into the audio sequence that represents a strike of a percussion instrument associated with the certain zone of the striking space where the user performed the striking motion.

The various features of the example implementations of the present invention may be combined and utilized in any order and in any combination.

Implementations of the present invention may present one or more of the following advantages. Latency and impression of user actions performed on a peripheral device are overcome, presenting a more realistic and accurate depiction of user actions in the virtual environment. Timing and precision of intended user actions, such as strikes, are maintained over an extended period of use. User selection of striking motions and actions are automatically determined based on the orientation of the peripheral device and the motion of the user action. Other advantages are possible.

BRIEF DESCRIPTION OF THE DRAWINGS

Various embodiments are disclosed in the following detailed description and accompanying drawings.

DETAILED DESCRIPTION

Overview

Figure 1A:
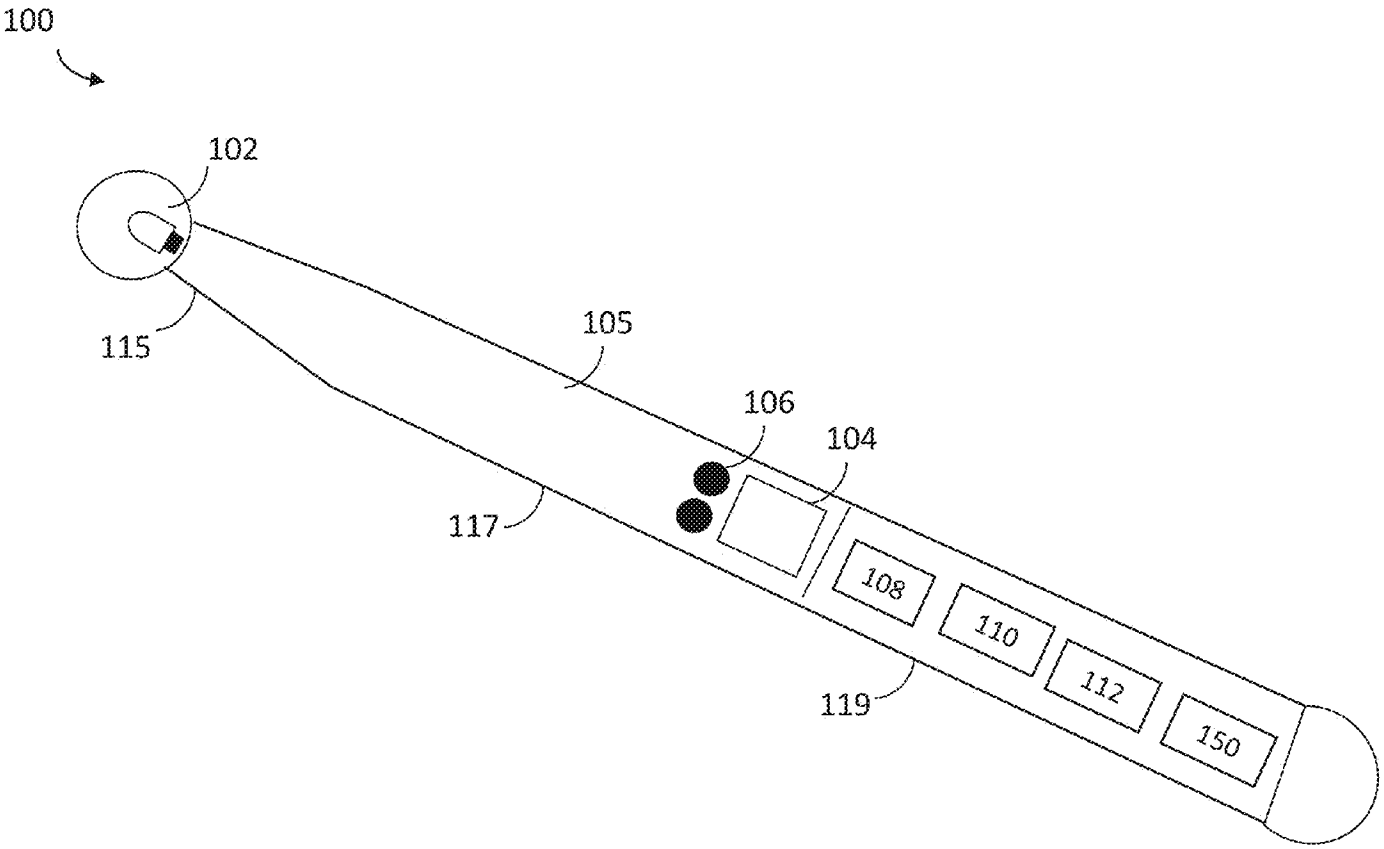
FIG. 1A is a diagram illustrating an example interactive drumstick.

Systems, methods, and devices for providing interactive striking objects (e.g., drumsticks) and performing actions in response to striking motions of the striking objects are disclosed.

In some embodiments, the systems and methods provide an interactive drumstick, which includes a lighting display located at a tip portion of the interactive drumstick, a motion detector contained at least partially within the drumstick, a processor and memory contained at least partially within the drumstick, and an interactive system stored within the memory of the drumstick. The interactive system includes a striking motion module that determines striking motions of the drumstick with respect to a virtual percussion instrument based on accessing information measured by the motion detector, and a display module that causes the lighting display to present a certain type of illumination based on the striking motions determined by the striking motion module.

In some embodiments, the systems and methods provide an interactive wand, which includes a housing, a feedback device, a motion detector contained at least partially within the housing, a processor and memory contained at least partially within the housing, and an interactive system stored within the memory. The interactive system includes a striking motion module that determines striking motions of the wand with respect to a virtual object based on accessing information measured by the motion detector, and a feedback module that causes the feedback device to perform an action based on the striking motions determined by the striking motion module.

For example, the systems and methods may generate an audio sequence of sounds by accessing movement information associated with drumsticks measured by a motion detector, the drumsticks performing striking motions with respect to a virtual drum set, and generate a sound for every striking motion performed with respect to the virtual drum set.

In some embodiments, the systems and methods include a drumstick state module that measures a state of motion of a drumstick relative to a virtual strike location for a virtual strike of a virtual drum to be performed by the drumstick, a strike prediction module that determines a predicted time at which the drumstick arrives at the virtual strike location for the virtual strike of the virtual drum based on the measured state of motion of the drumstick, and an action module that performs an action associated with a drumstick striking a real drum upon commencement of the determined predicted time.

For example, the systems and methods may generate an audio sequence based on a monitored movement of drumsticks with respect to virtual drum locations by monitoring movement of the drumsticks relative to the virtual drum locations, determining predicted times of virtual strikes performed by the drumsticks at the virtual drum locations, and generating an audio sequence that includes sounds to be played upon commencement of the determined predicted times of the virtual strikes at the virtual drum locations.

In some embodiments, the systems and methods may include a percussion object mapping module that maps percussion objects to respective zones of a striking space established around a user performing striking motions with respect to virtual percussion objects within the striking space using striking objects, a motion determination module that determines, for one or more striking motions performed by the user, the zones at which the striking motions occur, and an action module that performs an action based on occurrences of the striking motions within the determined zones.

For example, the systems and methods may generate an audio sequence by determining that a user has performed a striking motion within a certain zone of a striking space established around the user, and inserting a sound into the audio sequence that represents a strike of a percussion instrument associated with the certain zone of the striking space where the user performed the striking motion.

Thus, in some embodiments, the systems, methods, and devices described herein provide users with engaging and authentic musical experiences through use of interactive instruments and/or striking objects that represents percussive objects or other objects used to perform striking motions. In addition, the systems and methods facilitate calibrated and accurate interactions between striking motions performed by users with striking objects (interactive or non-interactive) and actions performed in response (or based on) the performed striking motions.

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and the equivalent.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Examples of Interactive Striking Objects

As described herein, in some embodiments, interactive striking objects and devices (or, objects and devices that represent striking objects) are described. The interactive striking objects may include interactive percussive objects (e.g., one or more drumsticks, one or more foot pedals, one or more mallets, and so on), interactive sports equipment objects (e.g., boxing gloves, hockey sticks, baseball bats, cricket bats, tennis rackets, table tennis paddles, and so on), interactive objects representing combat objects (e.g., swords), and other objects (or representative objects) used to strike a target object.

FIG. 1A is a diagram illustrating an example interactive drumstick 100. The interactive drumstick 100 includes a housing 105 having a shape similar to a drumstick, wand, mallet, or other elongated object shaped to strike an object, such as a drum or cymbal. The housing may include various portions, such as a tip portion 115, a shaft portion 117, and a handle portion 119.

The drumstick 100 may have a translucent or semi-translucent tip portion 115, and the various portions may be formed of plastic material, synthetic material, wood, rubber, silicone, or other similar materials. Also, the shaft portion 117 and/or the handle portion 119 may include a cover or grip, and may include or contain input elements 106 or other user interface elements (e.g., integrated touch input surfaces) that facilitate the reception of input from a user of the drumstick 100, such as input to control operation of various elements of the drumstick 100. For example, the input elements (e.g., buttons or other controls) 106 may start/stop operation of the drumstick or communication with external devices (e.g., via the music instrument digital interface (MIDI)).

In some embodiments, the drumstick 100 includes various user feedback devices. The drumstick 100 may include a lighting display or assembly 102, such as one or more light emitting diodes (LEDs). The lighting display 102 presents a variety of different types of illumination, such as various color and/or various display patterns (e.g., flashing sequences, held illumination, and so on), in response to different motions (or combinations thereof) of the drumstick 100. The drumstick 100 may also include a speaker 104 or other audio presentation components. The speaker 104 may present various sounds, such as drumbeats, music, human voices, and so on. The drumstick 100 may also include a vibration device, buzzer, or other haptic feedback device (not shown) that causes a portion of the drumstick 100 to vibrate in response to different motions (or combinations thereof) of the drumstick 100.

The housing 105 may contain (partially, or fully), one or more motion detectors 108, such as accelerometers, gyroscopes, and so on. The motion detectors 108 may be implemented and/or selected to detect, identify, or measure various types of motion (strokes or strikes) typical of a drumstick with respect to target objects (e.g., a single drum, one or more drums of a drum set, a cymbal, and so on). For example, the motion detector 108 may be a single nine-axis inertia measurement unit (IMU), or a group of sensors that measure movement in nine degrees of freedom, such as a 12 bit accelerometer (x,y,z), a 16 bit gyroscope (x,y,z) and a 12 bit-xy/14 bit-z magnetometer (x,y,z). In some embodiments, the motion detector 108 is calibrated to capture and measure various states of motion of the drumstick 100 during striking motions performed by a user, such as displacements, directions, speeds, accelerations, trajectories, orientations, rotations, and so on.

The drumstick 100 also includes a processor 110 and a memory 112, which manage the operation of various elements of the drumstick (e.g., the lighting display 102, the speakers 104, the motion detectors 108, and so on.). The processor 110 may include and/or communicate with a network interface (not shown) device, which facilitates communications between the drumstick 100 and other external devices. The network interface may support and/or facilitate over various communication or networking protocols, such as local area networks (LAN), cellular networks, or short-range wireless networks, Bluetooth® protocols, and so on. The memory 112 may store an interactive system 150, which includes components configured to provide an interactive experience to a user of the drumstick 100. Further details regarding the interactive system 150 are described herein.

Thus, in some embodiments, the interactive drumstick 100 includes an accelerometer, a gyroscope, a magnetometer, a color changing, Red-Green-Blue (RGB) LED, a power charging circuit capable of recharging a 3.7 volt lithium Ion battery, a 2.4 GHz RF module that communicates over the Bluetooth® Low Energy (BLE) protocol with +4 dBm output power and −93 dBm sensitivity, an antenna, a 32-bit or greater microprocessor, at least 256 KB of flash memory, at least 16 KB of random access memory (RAM), and other components that enable the drumstick 100 to provide an interactive experience to a user performing striking motions with the drumstick 100.

Figure 1B:
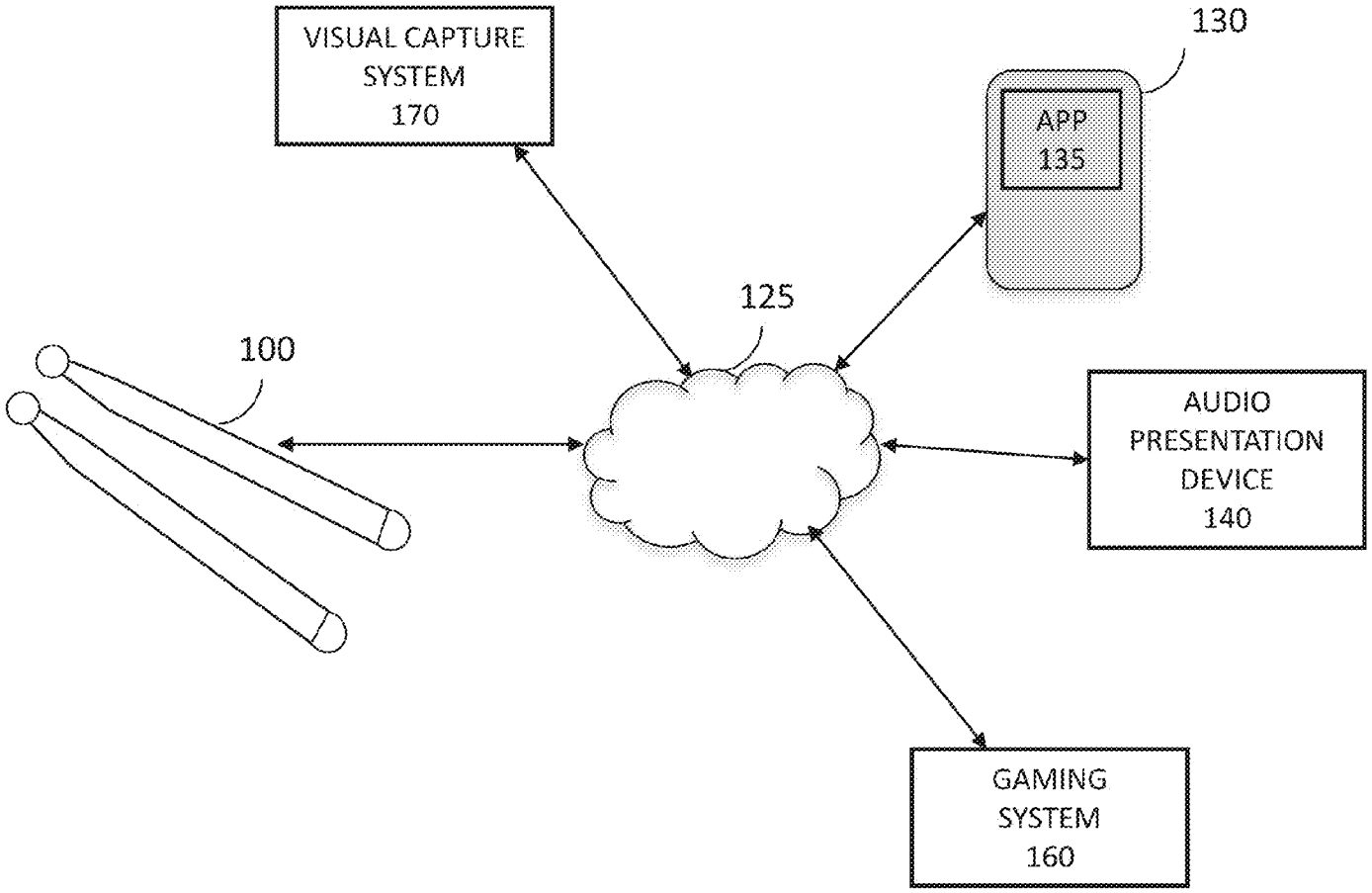
FIG. 1B is a block diagram illustrating a communication environment that includes a striking object and external devices.

As described herein, a striking object, such as the interactive drumstick 100, may be integrated with other external devices when providing an interactive experience to a user. FIG. 1B depicts a striking object 100 in communication over a network 125 with various external devices, such as a mobile device 130 supporting one or more mobile applications 135, an audio presentation device 140, a gaming system 160, and so on.

In some embodiments, the striking object 100 communicates with the mobile device 130 over the network 125, in order to provide the mobile device (and resident mobile application 130) with information associated with striking motions performed by the striking object 100, such as drum strokes, foot taps, and/or other striking motions (non-musical, for example). The mobile device 130 and/or mobile application 135, upon receiving the information, may perform various actions, such as play audio sequences, present visual graphics, and so on, that are associated with the striking motions associated with the received information.

In some embodiments, the striking object 100 communicates with the mobile device 130 and/or audio presentation device 140 over the network 125, in order to provide the mobile device (and resident mobile application 130) and/or audio presentation device 140 (e.g., an external speaker) with information associated with striking motions performed by the striking object 100, such as drum strokes, foot taps, and/or other striking motions (non-musical, for example). The mobile device 130, mobile application 135, and/or audio presentation device 140, upon receiving the information, may perform various actions, such as play audio sequences, present visual graphics, and so on, that are associated with the striking motions associated with the received information.

In some embodiments, the striking object 100 communicates with the gaming system 160 over the network 125, in order to provide the gaming system 160 with information associated with striking motions performed by the striking object 100, such as music-based striking motions (e.g., drum strokes), sports-based striking motions (e.g., tennis swings, baseball swings, boxing punches, and so on), combat-based striking motions (e.g., sword swings), and so on. The gaming system 160, upon receiving the information, may perform various actions, such as play audio or video sequences, perform game-based actions within a video game associated with the striking object 100, provide feedback to a user of the striking object 100, and so on.

As described herein, the striking object 100 may be or represent many different objects utilized to perform striking motions, and, therefore, the housing 105 of the striking object may take on various shapes, sizes, geometries, and/or configurations that fit in or on a user's hand, attach to a user's leg or foot, attach to real striking objects, and so on. Furthermore, in addition to the drumstick or wand shape depicted in FIG. 1B, the striking object 100 and/or portions of the housing 105 may be a variety of different shapes or configurations emblematic of various different striking objects. For example, the striking object may be and/or represent other percussive objects, other musical objects, sports objects, combat objects, gaming peripherals, and so on.

Other example striking objects include golf clubs, tennis/racquetball/badminton balls and rackets, baseball/cricket bats, steering wheels, boxing gloves, swords, knives, skate boards and poles, snow shoes, guns/weapons/nun-chucks, ski poles, hockey sticks, pool cues/billiards cues, darts, and other musical instruments, such as trumpets, flutes, and harmonicas.

In some embodiments, a visual capture system 170 associated with the network and proximate to the striking object 100, may include image sensors and other components capable of visually capturing striking motions performed by the striking object 100. For example, the visual capture system 170 may be various different motion capture input devices (e.g., the Kinect® system) configured to capture movements, gestures, and other striking motions performed by the striking object 100 using various sensors (RGB image sensors or cameras, depth sensors, and so on).

Thus, in some embodiments, the interactive system 150 may access and/or receive information associated with measured striking motions performed by the striking object 100 from the visual capture system 170 (and instead of from motion detectors 108 integrated with the striking object 100). In such cases, a user may utilize non-interactive striking objects, such as real drumsticks, real tennis rackets, and other objects, in order to perform striking motions, because the visual capture system 170 is able to measure the movement, orientation, and/or acceleration information used to determine the performed striking motions.

As described herein, in some embodiments, the memory 112 of the interactive drumstick 100, or another external device, such as the mobile device 130, the audio presentation device 140, the gaming system 160, the visual capture system 170, or other systems or devices that performs action in response to movement of striking objects, may include some or all components of the interactive system 150, which is configured to provide an interactive experience for users performing striking motions with the interactive drumstick 100 or other striking objects.

Figure 2:
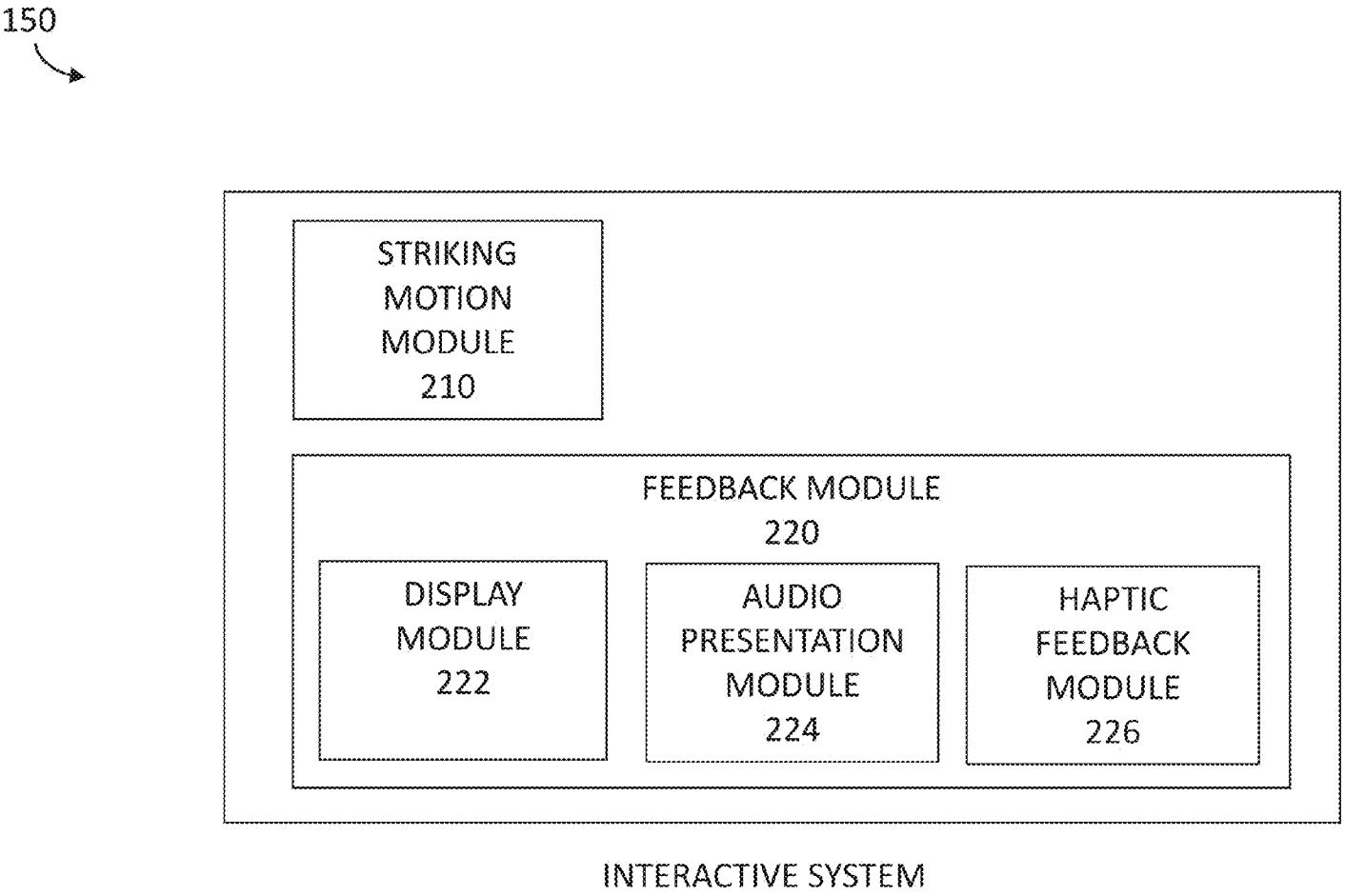
FIG. 2 is a block diagram illustrating components of an interactive system.

FIG. 2 is a block diagram illustrating components of the interactive system 150. The interactive system 150 may include one or more modules and/or components to perform one or more operations of the interactive system 150. The modules may be hardware, software, or a combination of hardware and software, and may be executed by one or more processors. For example, the interactive system 150 may include a striking motion module 210 and a feedback module 220, which includes a display module 222, an audio output module 224, and/or a haptic feedback module 226.

In some embodiments, the striking motion module 210 is configured and/or programmed to determine striking motions of a drumstick or wand with respect to a virtual percussion instrument based on accessing information measured by a motion detector. For example, the striking motion module 210 may determine a certain trajectory of movement of the drumstick based on information measured by the motion detector, may determine an acceleration (or, deceleration) of movement of the drumstick based on information measured by the motion detector, may determine a certain orientation in space of the drumstick based on information measured by the motion detector 108, and so on.

For example, the striking motion module 210 may detect or identify different types of striking motions of the drumstick 100, which correspond to different drum strokes (e.g., full/down/up/tab stroke, double stroke, multiple strokes, and so on) with respect to different types of percussive instruments (e.g., high/middle/floor tom drums, hi-hat/crash/ride cymbals, base/snare drums, and so on). The striking motion module 210 may identify certain movements of the drumstick 100 as drum strokes or strikes with respect to virtual percussive instruments (e.g., "air drumming") and/or a series of movements with respect to certain combinations of virtual percussive instruments (e.g., "air drumming" with respect to an "air drum set").

The striking motion module 210 may include information that defines locations of virtual striking surfaces for the virtual percussive instruments, such as positions or locations with respect to the user (e.g., the user's hands or feet), with respect to a surface, and/or with respect to other target locations that are proximate to areas where striking motions extend and/or end. For example, a full stroke may start with the tip portion 115 of the drumstick 100 being held 8-12 inches above a striking surface; and may include a striking motion having a trajectory that extends 8-12 inches towards a virtual percussive instrument and returns to the approximate start position. Therefore, the striking motion module 210 may determine a striking motion is a "full stroke" when the striking motion starts at a position 9 inches above a given striking surface, accelerates and decelerates on a trajectory having a length of 9 inches, and returns to the starting position.

Therefore, the striking motion module 210 may utilize some or all information captured and/or measured by the motion detectors 108 when determining the type of striking motion performed by the drumstick 100 or other striking object. The following table, which may be stored in memory 112 and/or within the striking motion module 210, provides examples of information measured by the motion detectors 108 and associated striking motions:

TABLE 1

| Striking Motion | Trajectory | Acceleration | Orientation |
|---|---|---|---|
| Full stroke | 8-12 inches | all | All |
| Full stroke on snare drum | 8-12 inches | all | Down, center |
| Full stroke on large tom drum | 8-12 inches | all | Down, right |
| Medium stroke | 3-7 inches | all | all |
| Medium stroke on hi-hat cymbal | 3-7 inches | weak | Down, left |
| Medium stroke on ride cymbal | 3-7 inches | strong | Up, right |
| . . . | . . . | . . . | . . . |

Of course, Table 1 presents a subset of potential striking motions and/or information utilized by the striking motion module 210 when determining a striking motion performed by the interactive drumstick 100, others are possible.

In some embodiments, the striking motion module 210 may utilize context information when determining a type of striking motion performed by the interactive drumstick 100 or other striking objects. For example, when the drumstick 100 is used with another drumstick (or foot pedal) by a user (as is common when drumming, or air drumming), the striking motion module 210 may access information identifying the striking motions of the paired drumstick 100 or foot pedal (e.g., from the striking motion module 210 of the other drumstick 100) when determining a striking motion for the drumstick 100.

Following the example, the striking motion module 210 may access information indicating a paired drumstick is performing striking motions identified as "full strokes on a snare drum," and determine, along with certain trajectory and orientation information measured by the motion detectors 108, that its drumstick 100 is performing striking motions of "medium strokes on a hi-hat cymbal."

As another example, the striking motion module 100 may access information identifying previous striking motions performed by the drumstick, and utilize such information when determining a current or future striking motion for the drumstick 100. The striking motion module 100 may access the most recent striking motion, a most recent set of striking motions, a most recent pattern of striking motions (e.g., a pattern of 2 striking motions of one type followed by a striking motion of a another type, repeated), and so on.

Following the example, the striking motion module 210 may access information indicating the drumstick 100 has performed a pattern of striking motions of "full stroke on crash cymbal," and three "medium strokes on a ride cymbal," three times in a row, and determine, along with information measured by the motion detectors 108, that the next striking motion of the drumstick 100 is a "full stroke on crash cymbal."

Thus, in some embodiments, the striking motion module 210 may utilize various types of context information when determining striking motions performed by the interactive drumsticks 100 or other striking objects, in order to more accurately determine a striking motion given imperfect or somewhat ambiguous measured information by the motion detectors 108 and/or in order to confirm determinations made using the information measured by the motion detectors 108.

In some embodiments, the feedback module 220 is configured and/or programmed to cause a feedback device to perform an action based on the striking motions determined by the striking motion module 210. For example, the feedback module may, via the display module 222, cause a lighting display to present a certain type of illumination based on the striking motions determined by the striking motion module 210, may, via the audio output module 224, cause a speaker to present sounds to a user associated with the drumstick that are indicative of the drumstick striking one or more virtual percussion instruments, may, via the haptic feedback module 226, cause a vibration component to vibrate based on the striking motions determined by the striking motion module 210, and so on.

The display module 222 may include preset or preconfigured parameters or settings for providing certain colors in response to determined striking motions, or may be configured by a user of the interactive drumstick 100. The display module may cause the lighting display 102 to display a specific color that represents a specific type of striking motion, and/or a specific pattern of striking motions (such as highlighting multiple bars, indicating specific note values (whole, half, quarter, eighth, sixteenth, and so on), indicating specific virtual percussive instruments, and so on). The light settings of the lighting display 102 may be configurable via an API or other programming interface. For example, displayed illumination may be set to produce random colors per drum strike, light up a specific color when a certain virtual percussive instrument is virtually struck, and so on.

For example, the display module 222 may display red illumination when a striking motion is determined to be a virtual strike of a virtual drum, and display green illumination when a striking motion is determined to be a virtual strike of a virtual cymbal. As another example, the display module 222 may display a first pattern of illumination when a striking motion is determined to be a full stroke, and a second pattern of illumination when a striking motion is determined to be a medium stroke.

Figure 3:
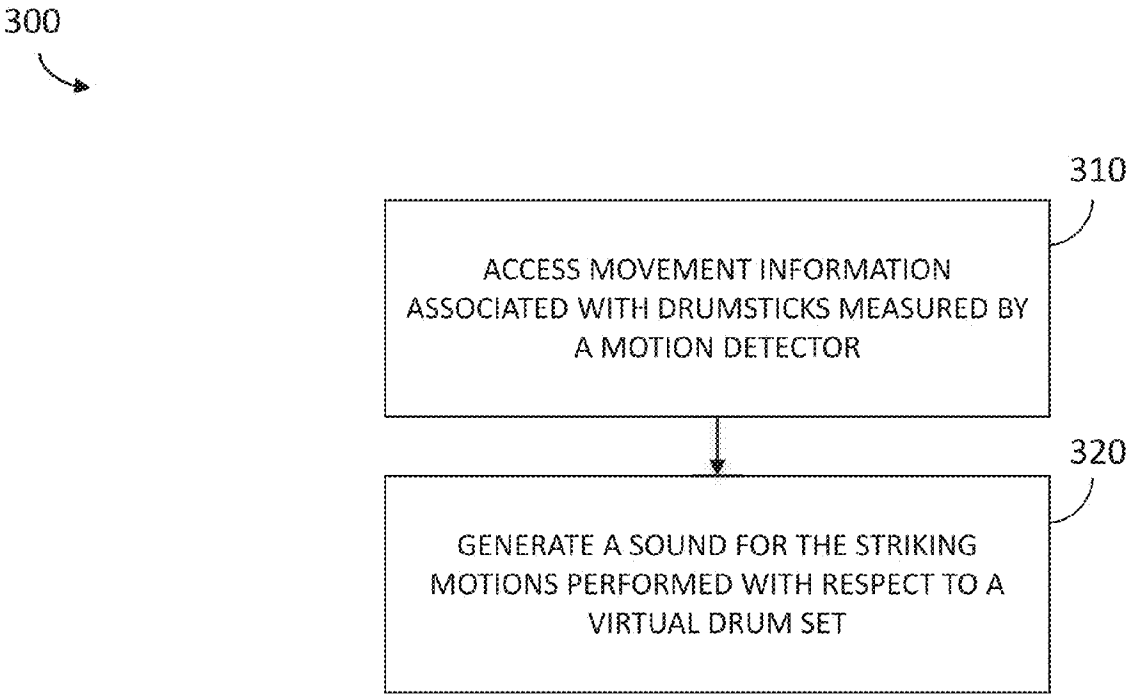
FIG. 3 is a flow diagram illustrating a method for generating an audio sequence of sounds in response to movement of a striking object.

As described herein, the interactive system 150 may perform various methods or processes when providing an interactive experience to a user performing striking motions with the interactive drumsticks 100. FIG. 3 is a flow diagram illustrating a method 300 for generating an audio sequence of sounds in response to movement of a striking object. The method 300 may be performed by the interactive system 150 and, accordingly, is described herein merely by way of reference thereto. It will be appreciated that the method 300 may be performed on any suitable hardware.

In operation 310, the interactive system 150 accesses movement information associated with drumsticks measured by a motion detector, the drumsticks performing striking motions with respect to a virtual drum set. The striking motion module 210 may determine a certain trajectory of movement of the drumstick based on information measured by the motion detector, may determine an acceleration (or, deceleration) of movement of the drumstick based on information measured by the motion detector, may determine a certain orientation in space of the drumstick based on information measured by the motion detector, and so on.

For example, the striking motion module 210 may access movement information from images captured by one or more image sensors via the visual capture system 170 and/or may access movement information measured by accelerometers and gyroscopes of the drumsticks, such as information associated with a trajectory and acceleration of the drumsticks with respect to a virtual drum set or other virtual target objects.

In operation 320, the interactive system 150 generates a sound for the striking motions performed with respect to the virtual drum set. For example, the feedback module 220 may, via the audio output module 224, cause a speaker to present sounds to a user associated with the drumstick that are indicative of the drumstick striking one or more virtual percussion instruments.

In some embodiments, the feedback module 220 may generate sounds specific to the determined striking motions and virtual percussive instruments associated with the determined striking motions. For example, the interactive system 150 may identify a virtual drum or virtual cymbal of a virtual drum set that is associated with the striking motion, determine a force of a strike of the virtual drum or virtual cymbal during the striking motion, and generate a sound that is indicative of a real drum or real cymbal represented by the virtual drum or virtual cymbal and based on the determined force of the strike of the virtual drum or virtual cymbal.

As described herein, in addition to speakers 104 integrated with the drumstick 100 the feedback module 220 may cause various external devices to generate and/or perform sounds specific to the determined striking motions. For example, the feedback module 220 may cause the mobile device 130 (e.g., via the mobile application 135) associated with the drumsticks 100 to play the generated audio sequence, and/or may cause the audio presentation device 140 to play the generated audio sequence.

In some embodiments, the drumstick 100 may be utilized in a variety of different modes or applications, such as learning modes, playing modes, and other applications. For example, in a learning mode, the drumstick 100 helps a user learn how to play drums through light signals or other means, such a vibration or auditory signals. The interactive drumstick 100 may provide the user with visual, audio, or other types of feedback when performing striking motions. In a playing mode, the interactive drumstick 100 enables the user to play along with songs, audio sequences, or with other users.

In some embodiments, the interactive system 150 (which may be integrated with the drumstick or part of an external device) receives a sequence of striking motions, determines a corresponding series of light signals, and sends the series of light signals to the lighting display 102. For example, the interactive system 150 may access a drum transcription stored in memory 112 and/or may receive MIDI commands transmitted directly from another musical instrument and/or through a MIDI controller.

The interactive system 150, based on certain content of an accessed drum transcription or sequence of MIDI commands, identifies a striking motion to be performed, and the corresponding light signal, causing the lighting display 102 to display the determined light signal. In response to the light signal, a user performs an associated striking motion, which is measured by the motion detectors 108. The interactive system 150 determines the striking motion as a certain type of striking motion, and compares the determined type of striking motion of the drumstick 100 to the striking motion corresponding to the displayed light signal, to assess whether the user has performed the correct striking motion.

In some cases, the interactive system 150 may rate or score the user based on an accuracy of performed striking motions and/or speed of performing correct striking motions. For example, the interactive system 150 may provide immediate feedback, such as the displayed color at a higher intensity or certain pattern, and/or may provide feedback after a user has performed a sequence of striking motions.

In some cases, the interactive system 150 may provide audio feedback during the learning mode of operation. For example, the interactive system 150 may play sounds that correspond to the displayed light signals, may play sounds that correspond to performed striking motions, and so on.

In some embodiments, in response to a user performing striking motions using the interactive drumstick 100, the motion detector 108 detects a type of striking motion of the drumstick 100, and the interactive system 150 stores information that identifies the detected type of striking motion in memory 112. The interactive system 150 determines a light signal corresponding to the detected type of striking motion, and causes the lighting display 102 to display the determined light signal. Thus, the interactive system 150 displays a sequence of illumination that corresponds to the user's drum play (e.g., striking motions)

In some cases, the interactive system 150 may store a series of striking motions as a drum transcription, which may be utilized during the learning mode operation. For example, a teacher may record a set of combinations of drum strokes and drum elements in the playing mode of operation, and a student may follow the combinations in the learning mode of operation via displayed light signals.

Various applications and/or experiences may utilize the interactive striking objects described herein. For example, a disk jockey (DJ) may use a 3.5 mm audio jack/cable to connect the mobile device 130 into his/her audio equipment, and mix sounds generated by striking motions performed by the interactive drumsticks 100 in real-time. As another example, the interactive system 150 may combine sounds generate for a user with recorded music and/or sounds generated for other users of interactive drumsticks 100. As another example, the interactive system 150 may cause other types of wands, such as glow sticks, to change colors in response to sounds, audio sequences, striking motions, and so on.

As described herein, the interactive system 150 may perform actions in response to a series of determined striking motions using multiple percussive striking objects, such as striking motions with respect to a virtual drum set. For example, a user may perform striking motions with a left interactive drumstick, a right interactive drumstick, a left interactive foot pedal, and a right interactive foot pedal, mimicking striking motions the user would perform on an actual drum set.

For example, the left interactive foot pedal may be mapped to a hi-hat cymbal, and the right interactive foot pedal may be mapped to a bass drum, and the interactive drumsticks may be mapped to a snare drum, tom drums, and cymbals. Once the user begins performing striking motions using the various percussive striking objects, their associated motion detectors 108 (accelerometers, gyroscopes, compasses or magnetometers, and so on), measure information associated with the striking motions. The interactive system 150 access and/or receives the information and determines the striking motions as being associated with certain drum strokes or sounds. The interactive system 150 perform various actions in response to the determined striking motions, such as display illumination feedback, playing the sounds that correspond to the striking motions, generating audio sequences and causing external device to store and/or play back the audio sequences, and so on.

Thus, in some embodiments, the interactive striking objects and interactive system 150 described herein provide users with real-time, accurate, immersive musical or other action experiences by providing various interactions and feedback during performed striking motions of striking objects.

Examples of Determining Types of Striking Motions

As described herein, in some embodiments, the interactive system 150 may include a striking motion detection system 400, which is configured to determine striking motions based on established and mapped locations or zones within which the striking motions are performed.

Figure 4:
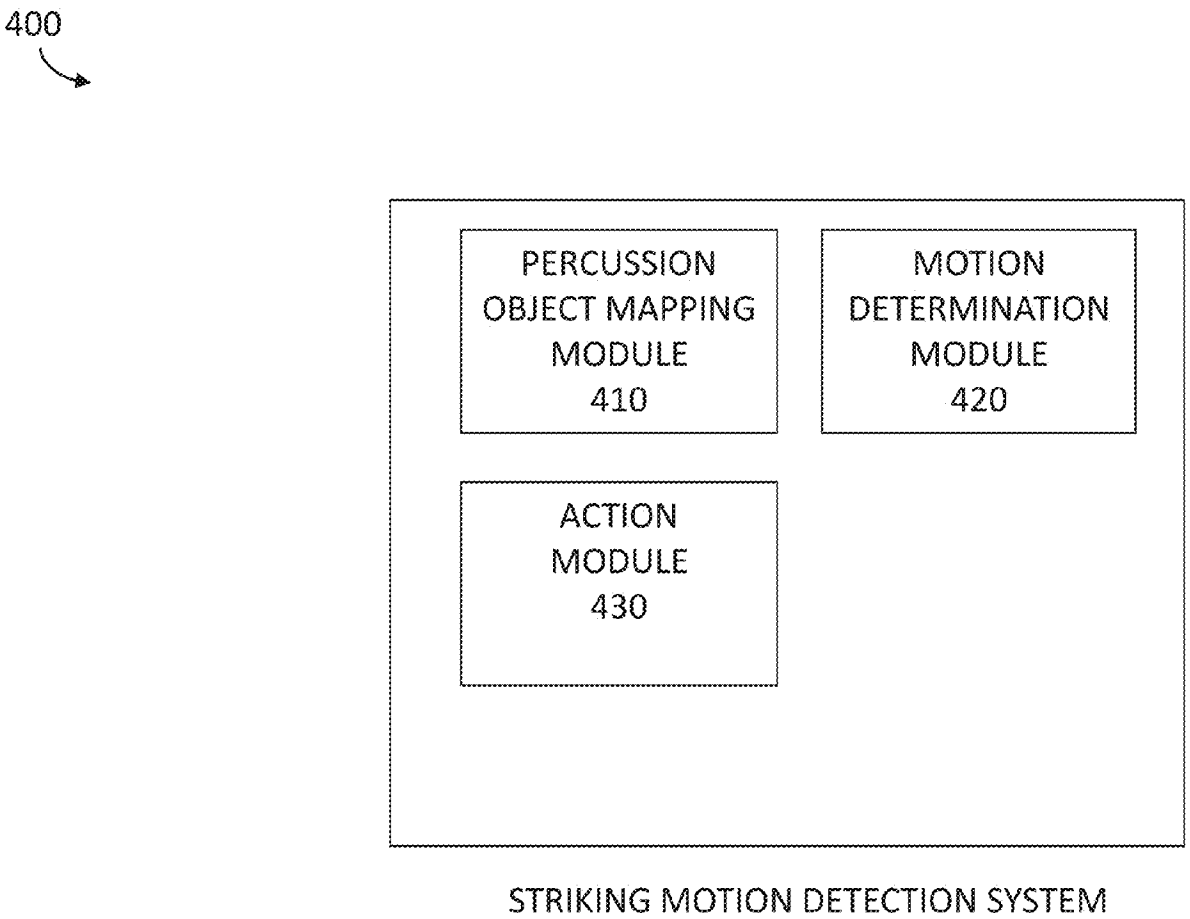
FIG. 4 is a block diagram illustrating components of a striking motion detection system.

FIG. 4 is a block diagram illustrating components of the striking motion detection system 400. The striking motion detection system 400 may include one or more modules and/or components to perform one or more operations of the striking motion detection system 400. The modules may be hardware, software, or a combination of hardware and software, and may be executed by one or more processors. For example, the striking motion detection system 400 may include a percussion object mapping module 410, a motion determination module 420, and an action module 430.

In some embodiments, the percussion object mapping module 410 is configured and/or programmed to map percussion objects to respective zones of a striking space established around a user performing striking motions with respect to virtual percussion objects within the striking space using striking objects.

Figure 5A:
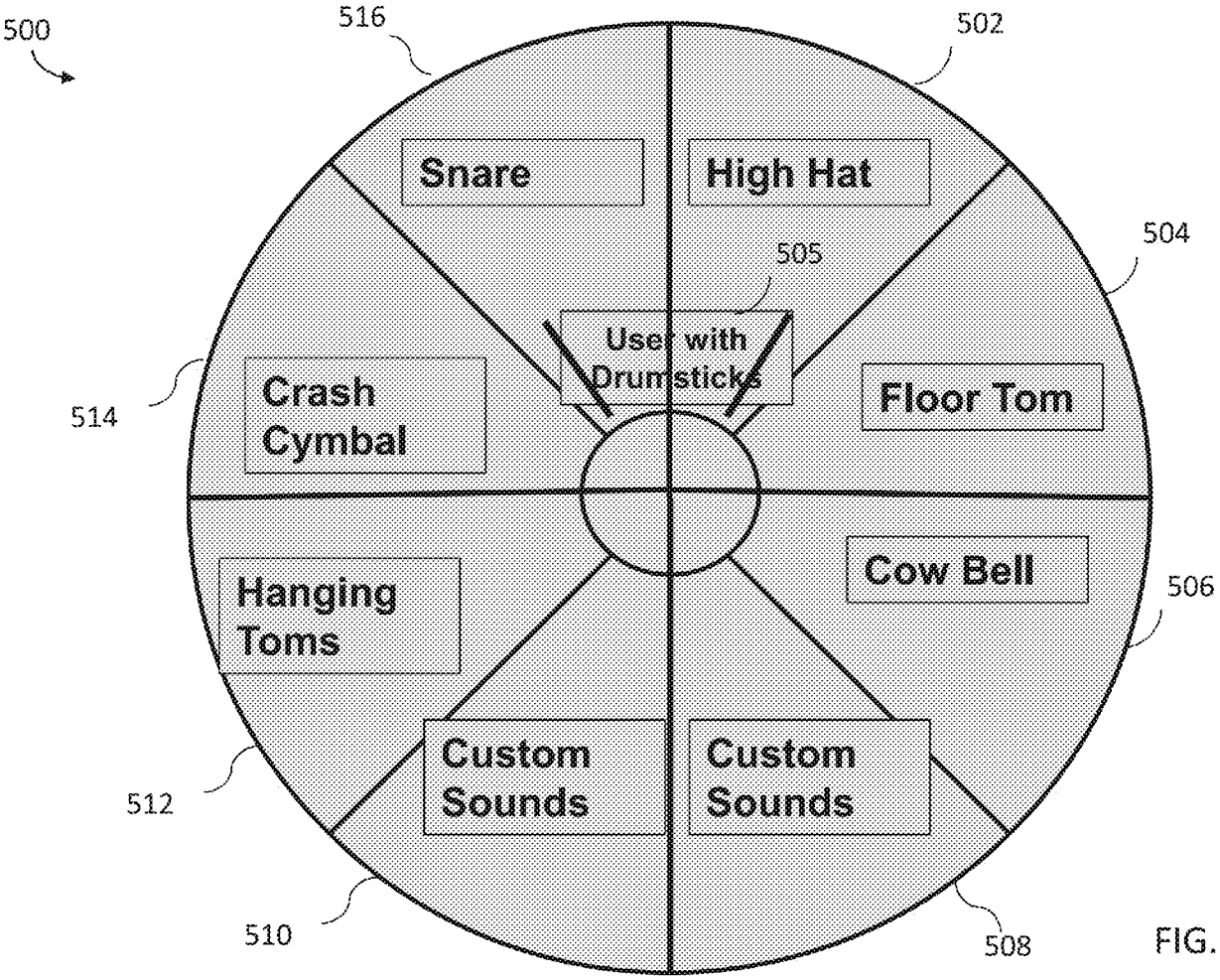
FIGS. 5A-5C are diagrams illustrating maps of striking spaces having zones associated with target objects.
Figure 5B:
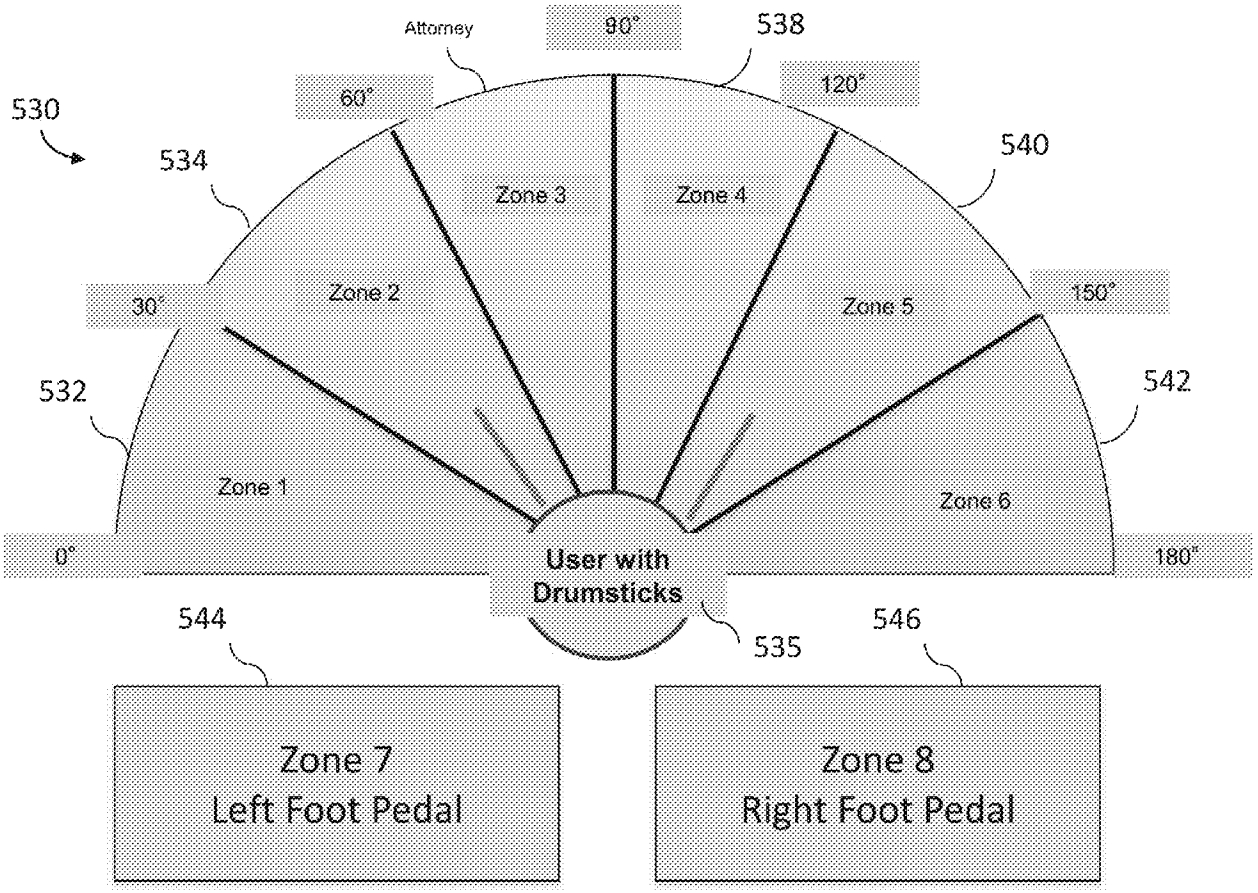
Figure 5C:
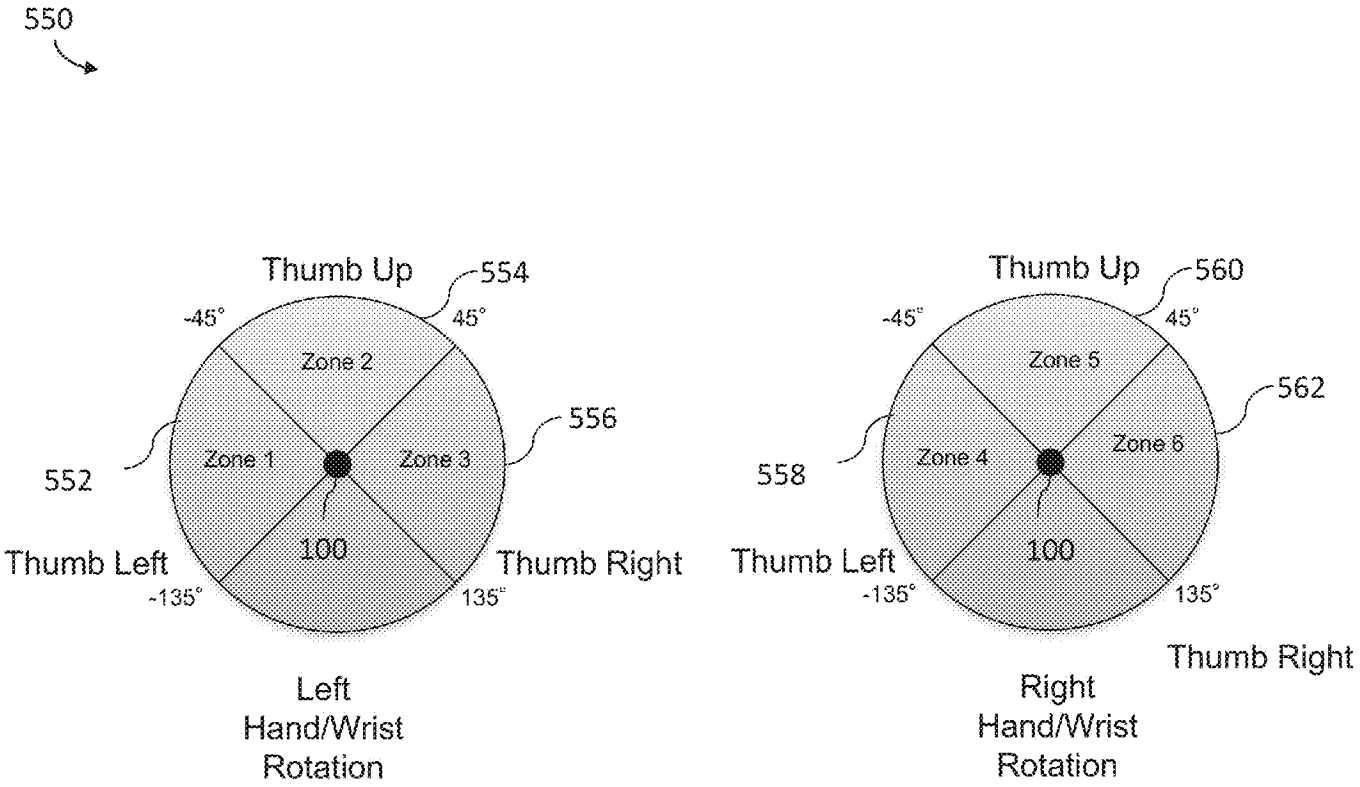

As described herein, the striking motion detection system 400 may create or generate a map of zones having a layout that correspond to a striking space (e.g., the space surrounding a user performing striking motions) including various different percussion objects, such as drums and cymbals of a drum set. FIGS. 5A-5C depict different maps of striking spaces having zones associated with target objects.

Referring to FIG. 5A, the striking motion detection system 400 establishes a striking space 500 surrounding a user 505 performing striking motions with interactive drumsticks 100 or other striking objects. The striking space includes many different zones that correspond to virtual percussion objects (e.g., virtual target objects) at locations within the striking space 500 that correspond to locations of real percussion objects of a real drum set.

For example, starting at zero degrees and moving clockwise within the striking space 500, zone 502 corresponds to a high hat cymbal, zone 504 corresponds to a floor tom drum, zone 506 corresponds to a cowbell, zones 508 and 510 correspond to custom or user selectable percussion objects, zone 512 corresponds to hanging tom drums, zone 514 corresponds to a crash cymbal, and zone 516 corresponds to a snare drum.

In some embodiments, the striking space 500 may include zones that correspond to percussion objects typically struck by drumsticks and/or foot pedals. For example, one or more of the zones 502-516 may be mapped to a bass drum, hi-hat pedal, a second bass drum, or other percussion objects associated with foot pedal striking motions.

Referring to FIG. 5B, the striking motion detection system 400 establishes a striking space 530 surrounding a user 535 performing striking motions with interactive drumsticks 100 or other striking objects. The striking space 530 is based on an azimuth plane that extends in an outward direction, relative to the user 535. The azimuth plane is divided into uniform zones mapped to virtual percussion objects, with each zone having a size determined by the number of zones. As depicted in FIG. 5B, the striking space 530 extends from 0 degrees to 180 degrees, with each zone 532-542 occupying 30 degrees, or $1/6^{th}$, of the striking space. The striking space 530 may also include zones 544 and 546, which map to foot pedal percussion objects.

Referring to FIG. 5C, the striking motion detection system 400 establishes a striking space 550 surrounding azimuth positions of the interactive drumsticks 100 performing striking motions, where zones are determined by the rotation of a user's hand, arm, or wrist in a predetermined direction. For example, the striking space 550 surrounding the user's wrist movement is divided into zones 552-562, where the zones correspond to virtual percussion objects.

The zones are established as follows: a "Left Hand Thumb Left" orientation establishes zone 552, a "Left Hand Thumb Up" orientation establishes zone 554, a "Left Hand Thumb Right" orientation establishes zone 556, a "Right Hand Thumb Left" orientation establishes zone 558, a "Right Hand Thumb Up" orientation establishes zone 560, and a "Right Hand Thumb Right" orientation establishes zone 562.

Referring back to FIG. 4, in some embodiments, the motion determination module 420 is configured and/or programmed to determine, for one or more striking motions performed by the user, the zones at which the striking motions occur (the zones at which the striking motions are performed). For example, the motion determination module 420 may identify a direction or orientation of the striking object during the striking motion, and select a zone of the striking space that includes the identified direction or orientation.

As described herein, the motion determination module 420 may determine zones at which striking motions are performed within a variety of different striking spaces, such as striking spaces 500, 530, 550, and so on. For example, the motion determination module 420 may identify a geospatial azimuth position relative to the user within the striking space (e.g., striking space 530) of the striking object during the striking motion, and select a zone of the striking space that includes the identified geospatial azimuth position.

As another example, the motion determination module 420 may identify a direction of the striking object during the striking motion and an orientation of the striking object within a hand of the user (e.g., within striking space 550), and select a zone of the striking space that includes the identified direction and identified orientation of the striking object within the hand of the user.

In some embodiments, the action module 430 is configured and/or programmed to perform an action based on occurrences of the striking motions within the determined zones. For example, the action module 430 may cause a sound that represents a strike of a percussion object associated with the determined zone to be inserted into an audio sequence of percussive sounds, may cause a sound that represents a strike of a percussion object associated with the determined zone to be played by the mobile device 130 associated with the user, and/or may perform other actions described herein.

Figure 6:
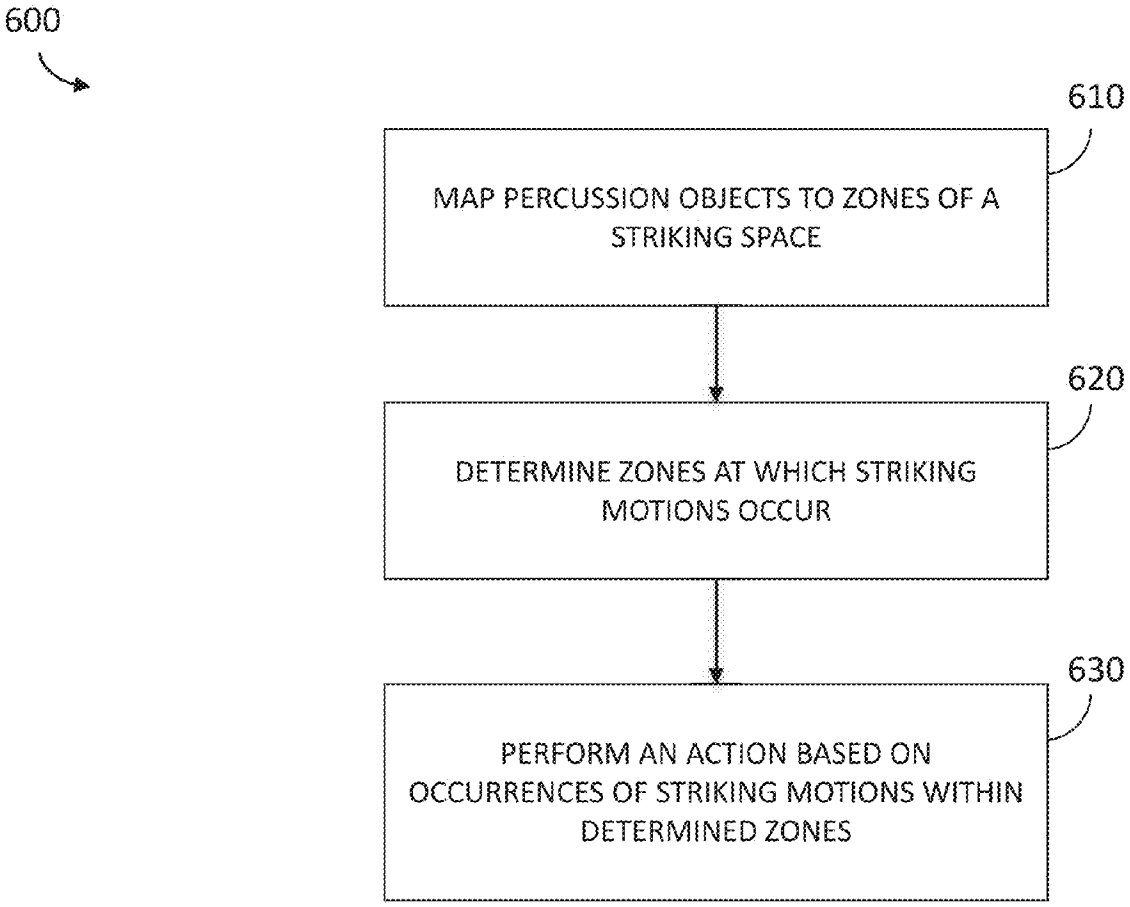
FIG. 6 is a flow diagram illustrating a method for performing an action in response to determining a location of a striking motion associated with a striking object.

As described herein, the striking motion detection system 400 may perform various methods or processes to accurately determine striking motions performed by striking objects, and perform actions based on the striking motions. FIG. 6 is a flow diagram illustrating a method 600 for performing an action in response to determining a location of a striking motion associated with a striking object. The method 600 may be performed by the interactive system 150 and, accordingly, is described herein merely by way of reference thereto. It will be appreciated that the method 600 may be performed on any suitable hardware.

In operation 610, the striking motion detection system 400 maps one or more percussion objects to respective zones of a striking space established around a user performing striking motions with respect to virtual percussion objects within the striking space using striking objects. For example, the percussion object mapping module 410 may create or generate a map of zones having a layout that correspond to a striking space (e.g., striking spaces 500, 530, 550) including various different percussion objects, such as drums and cymbals of a drum set.

In operation 620, the striking motion detection system 400 determines, for one or more striking motions performed by the user, the zones at which the striking motions occur. For example, the motion determination module 420 may identify a direction or orientation of the striking object during the striking motion, and select a zone of the striking space that includes the identified direction or orientation.

In operation 630, the striking motion detection system 400 performs an action based on occurrences of the striking motions within the determined zones. For example, the action module 430 may cause a sound that represents a strike of a percussion object associated with the determined zone to be inserted into an audio sequence of percussive sounds, may cause a sound that represents a strike of a percussion object associated with the determined zone to be played by the mobile device 130 associated with the user, and/or may perform other actions described herein.

Thus, in some embodiments, the striking motion detection system 400 may perform operations for generating an audio sequence, by determining that a user has performed a striking motion within a certain zone of a striking space established around the user, and inserting a sound into the audio sequence that represents a strike of a percussion instrument associated with the certain zone of the striking space where the user performed the striking motion.

In some cases, the striking motion detection system 400 may generate audio sequences of fast, repeating striking motions, using the various established striking spaces 500, 530, 550 in order to accurately detect a location of the striking motions. For example, the striking motion detection system 400 may utilize a calibrated magnetometer to establish geospatial azimuth location zones for short periods of time before compass drift due to changes in magnetic signature become significant, and re-calibration is performed.

In some embodiments, due to motion sensor inaccuracies and accumulating mathematical rounding errors, the calculated position of an interactive drumstick 100 may have an associated inaccuracy that degrades over time. To correct for the inaccuracies, the striking motion detection system 400 recalibrates to an initial striking position to the center of the zone, after some or all performed striking motions. For example, when the drumstick performs a striking motion at 20 degrees, the current drumstick position is set to the center of the corresponding (e.g., 15 degrees, with zone 532 of FIG. 5B).

Thus, in some embodiments, the striking motion detection system 400 establishes striking spaces having zones that map to virtual percussion objects, and utilizes these striking spaces to accurately determine the intent (e.g., the target percussion object) for performed striking motions.

Of course, the striking motion detection system 400 may be utilized with other striking objects, such as those described herein. For example, a tennis simulation game, where a user swings a racket shaped striking object at moving virtual tennis balls, may utilize the striking motion detection system 400 when determining locations the racket shaped striking object performs striking motions, such as striking motions with respect to the moving virtual tennis balls. Following the example, the striking motion detection system 400 may establish striking spaces that surround the user and/or the racket shaped striking objects, and perform method 600 to determine the actions to perform (e.g., cause a game to simulate a certain tennis shot) in response to determining the zones in which tennis swings are located and/or the speed of the tennis swings.

Examples of Performing Actions in Response to Predictive Strike Determinations

In some cases, due to inherent delays in communication over networks, processing components, feedback devices, and so on, the interactive system 150 may provide a less than ideal experience with respect to playing sounds, displaying illumination, and/or provide haptic feedback at an exact or approximate moment when a striking motion performed by a striking object reaches a location associated with a virtual target object. For example, a user may perform an air drumming striking motion at an intended virtual snare drum, and the interactive system 150 may cause a snare drum sound to be played after, and not during, the striking motion is at a virtual strike location of the virtual snare drum, due to hardware and other limitations. Furthermore, such delayed feedback responses, when collected, may cause generated audio sequences from many sequential striking motions to be inaccurate and less than desirable to the user.

To remedy these potential issues, in some embodiments, the interactive system 150 includes a predictive strike system 700 configured to perform actions in response to predicting the time at which a striking motion performs a virtual strike of a virtual target object.

Figure 7:
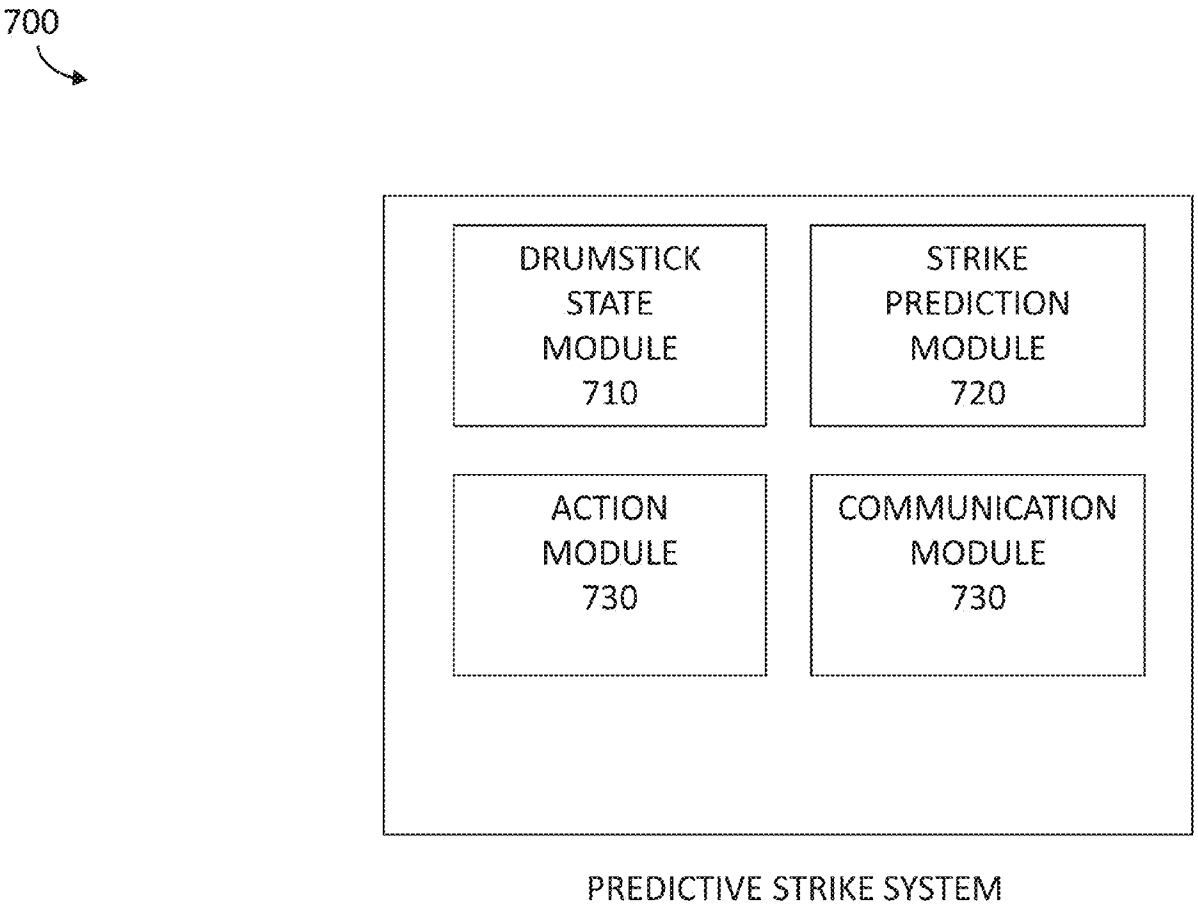
FIG. 7 is a block diagram illustrating components of a predictive strike system.

FIG. 7 is a block diagram illustrating components of the predictive strike system 700. The predictive strike system 700 may include one or more modules and/or components to perform one or more operations of the predictive strike system 700. The modules may be hardware, software, or a combination of hardware and software, and may be executed by one or more processors. For example, the predictive strike system 700 may include a drumstick state module 710, a strike prediction module 720, an action module 730, and a communication module 740.

In some embodiments, the drumstick state module 710 is configured and/or programmed to measure a state of motion of a drumstick relative to a virtual strike location for a virtual strike of a virtual drum to be performed by the drumstick. For example, the drumstick state module 710 may determine a certain trajectory of movement of the drumstick based on information measured by the motion detector, may determine an acceleration (or, deceleration) of movement of the drumstick based on information measured by the motion detector, may determine a certain orientation in space of the drumstick based on information measured by the motion detector, and so on.

In some cases, the drumstick state module 710 may access calibration information, such as information associated with a baseline state of motion of the drumstick and/or information associated with a sampling cycle for measuring information about the state of motion of the drumstick 100. The sampling rate may be 1 sample every 30 ms or less.

In some embodiments, the strike prediction module 720 is configured and/or programmed to determine a predicted time at which the drumstick arrives at the virtual strike location for the virtual strike of the virtual drum based on the measured state of motion of the drumstick. The strike prediction module 720 may measure from the identified state of motion of the drumstick relative to the virtual strike location, a current acceleration and trajectory of the drumstick within three-dimensional space with respect to the virtual strike location of the virtual drum, and determine the predicted time as a time at which a tip portion of the drum stick is expected to arrive at the virtual strike location based on the measured acceleration and trajectory of the drumstick with respect to the virtual strike location.

For example, the strike prediction module 720 may determine the predicted time as a time at which the predicted state of motion of the drumstick is associated with the drumstick decelerating to approximately zero acceleration proximate to the virtual strike location of the virtual drum, and/or may determine the predicted time as a time at which a trajectory of the drumstick within three-dimensional space with respect to the virtual strike location of the virtual drum is predicted to change from a first direction towards the virtual strike location of the virtual drum to a second direction away from the virtual strike location of the virtual drum.

In some embodiments, the action module 730 is configured and/or programmed to perform an action associated with a drumstick striking a real drum upon commencement of the determined predicted time. For example, the action module 730 may cause the audio presentation device 130, 140 associated with a user of the drumstick to play a sound indicative of the drumstick striking the real drum associated with the virtual drum at the virtual drum location, may cause the audio presentation device 130, 140 associated with a user of the drumstick to play a sound that is based on the real drum associated with the virtual drum at the virtual drum location and a measured strike force applied from the drumstick to the virtual drum during the virtual strike, and so on.

In some embodiments, the communication module 740 communicates a message whose contents include information representing the determined predicted time and information representing the identified state of motion of the drumstick from the strike prediction module 720 to the action module 730. For example, when the drumstick state module 710 and the strike prediction module 720 are located within the drumstick, and wherein the action module 730 is located within the mobile application 135 supported by the mobile device 130 associated with a user of the drumstick 100, the communication module 740 may communicate a message whose contents include information representing the determined predicted time and information representing the identified state of motion of the drumstick from the strike prediction module 720 to the action module 730, and/or may communicate a message from the strike prediction module to the action module before a tip portion of the drum stick arrives at the virtual strike location of the virtual drum, the message including information representing the determined predicted time and information representing the identified state of motion of the drumstick.

Figure 8:
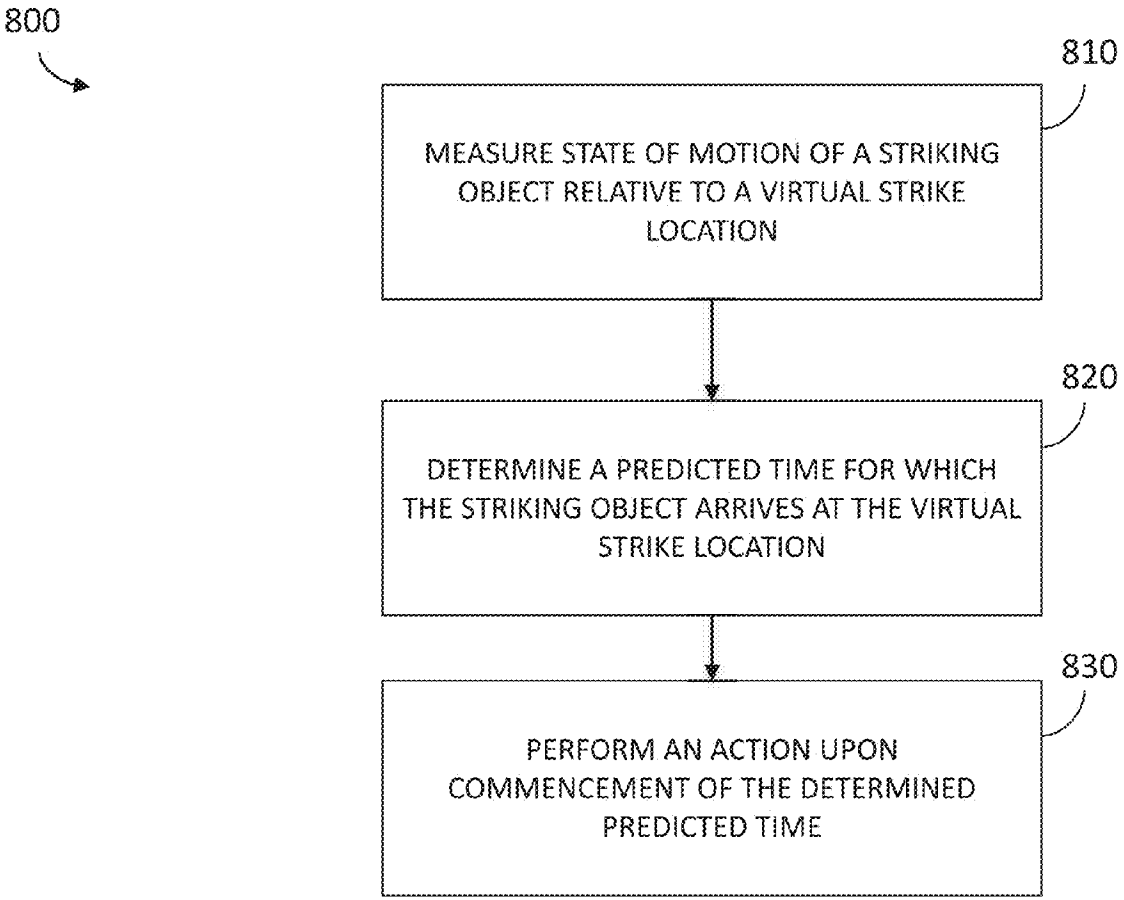
FIG. 8 is a flow diagram illustrating a method for performing an action in response to a striking motion performed by a striking object.

As described herein, the predictive strike system 700 may perform various processes or methods when performing actions in response to predicted times where striking motions arrive at virtual strike locations. FIG. 8 is a flow diagram illustrating a method 800 for performing an action in response to a striking motion performed by a striking object. The method 800 may be performed by the predictive strike system 700 and, accordingly, is described herein merely by way of reference thereto. It will be appreciated that the method 800 may be performed on any suitable hardware.

In operation 810, the predictive strike system 700 measures a state of motion of a striking object relative to a virtual strike location for a virtual strike of a virtual percussion instrument to be performed by the striking object. For example, the drumstick state module 710 may determine a certain trajectory of movement of the drumstick based on information measured by the motion detector, may determine an acceleration (or, deceleration) of movement of the drumstick based on information measured by the motion detector, may determine a certain orientation in space of the drumstick based on information measured by the motion detector, and so on.

In operation 820, the predictive strike system 700 determines a predicted time at which the striking object arrives at the virtual strike location for the virtual strike of the virtual percussion instrument based on the measured state of motion of the striking object. For example, the strike prediction module 720 may determine the predicted time as a time at which the predicted state of motion of the drumstick is associated with the drumstick decelerating to approximately zero acceleration proximate to the virtual strike location of the virtual drum, and/or may determine the predicted time as a time at which a trajectory of the drumstick within three-dimensional space with respect to the virtual strike location of the virtual drum is predicted to change from a first direction towards the virtual strike location of the virtual drum to a second direction away from the virtual strike location of the virtual drum.

In operation 830, the predictive strike system 700 performs an action associated with the striking object striking a real percussion instrument upon commencement of the determined predicted time. For example, the action module 730 may cause playback of a sound indicative of a drumstick striking a drum or cymbal, a sound indicative of a foot pedal striking a drum or engaging a cymbal, and so on.

Figure 9:
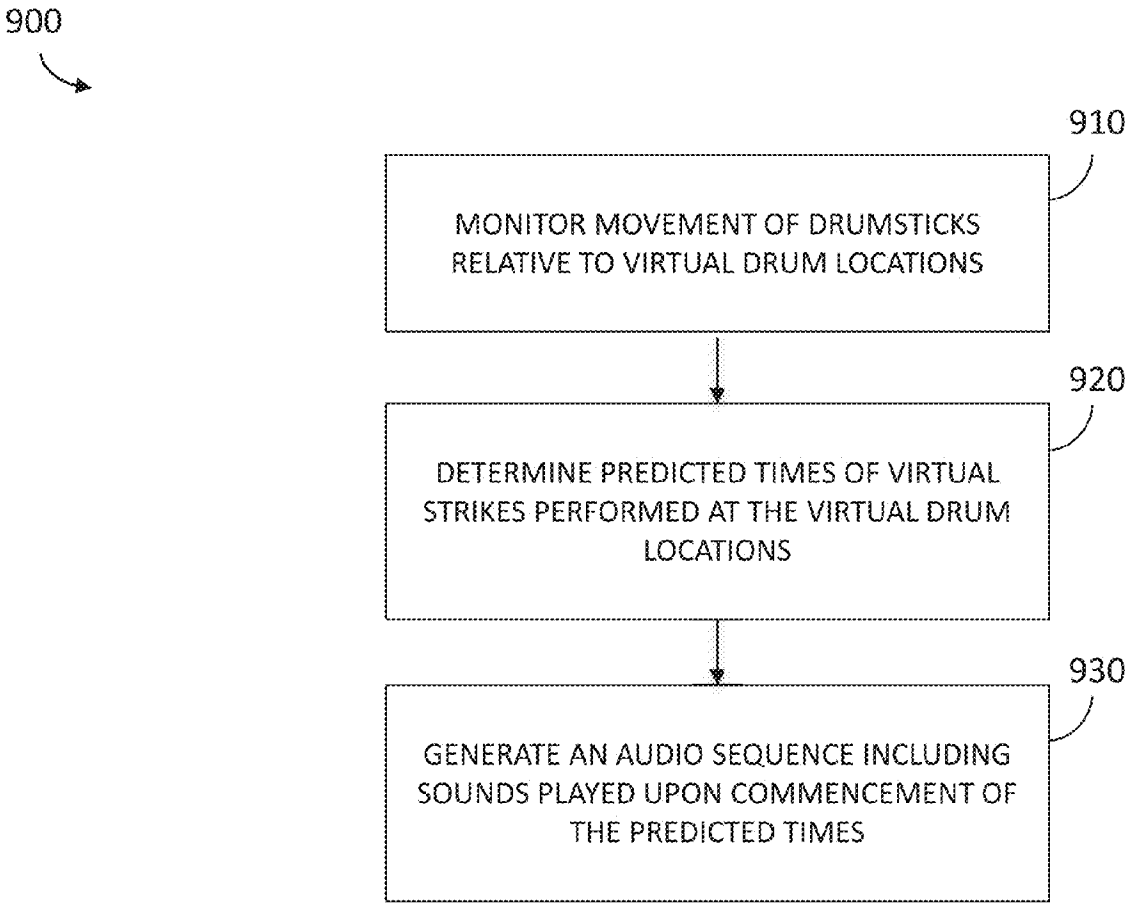
FIG. 9 is a flow diagram illustrating a method for generating an audio sequence based on movement of drumsticks with respect to virtual drum locations.

FIG. 9 is a flow diagram illustrating a method 900 for generating an audio sequence based on movement of drumsticks with respect to virtual drum locations. The method 900 may be performed by the predictive strike system 700 and, accordingly, is described herein merely by way of reference thereto. It will be appreciated that the method 900 may be performed on any suitable hardware.

In operation 910, the predictive strike system 700 monitors movement of the drumsticks relative to the virtual drum locations. For example, the drumstick state module 710 may determine a certain trajectory of movement of the drumsticks based on information measured by the motion detector, may determine an acceleration (or, deceleration) of movement of the drumstick based on information measured by the motion detector, may determine a certain orientation in space of the drumstick based on information measured by the motion detector, and so on.

In operation 920, the predictive strike system 700 determines predicted times of virtual strikes performed by the drumsticks at the virtual drum locations. For example, the strike prediction module 720 may determine the predicted times as times at which the predicted states of motion of the drumsticks are associated with the drumsticks decelerating to approximately zero acceleration proximate to the virtual strike location of the virtual drum, and/or may determine the predicted times as times at which a trajectory of the drumsticks within three-dimensional space with respect to the virtual strike location of the virtual drum is predicted to change from a first direction towards the virtual strike location of the virtual drum to a second direction away from the virtual strike location of the virtual drum.

In operation 930, the predictive strike system 700 generates an audio sequence that includes sounds to be played upon commencement of the determined predicted times of the virtual strikes at the virtual drum locations. For example, the action module 730 may generate for every virtual strike at a virtual drum location, a sound that is based on a specific virtual drum associated with the virtual drum location and a measured strike force applied from the drumstick to the specific virtual drum during the virtual strike.

Thus, in some embodiments, the predictive strike system 700 enables the interactive system 150 to accurately perform actions in real-time or near real-time that are based on determined striking actions at virtual strike locations.

Of course, the predictive strike system 700 may be utilized with other striking objects, such as those described herein. For example, the tennis simulation game example described herein, where a user swings a racket shaped striking object at moving virtual tennis balls, may utilize the predictive strike system 700 when providing instantaneous feedback in response to striking motions performed with respect to moving virtual tennis balls. Following the example, the predictive strike system 700 may predict a time at which a current tennis swing will arrive at a location, along with a virtual tennis ball, and cause the simulation game to present a multimedia game sequence depicting a game character hitting a displayed tennis ball at the predicted time.

Examples of a Suitable Computing Environment

Figure 10:
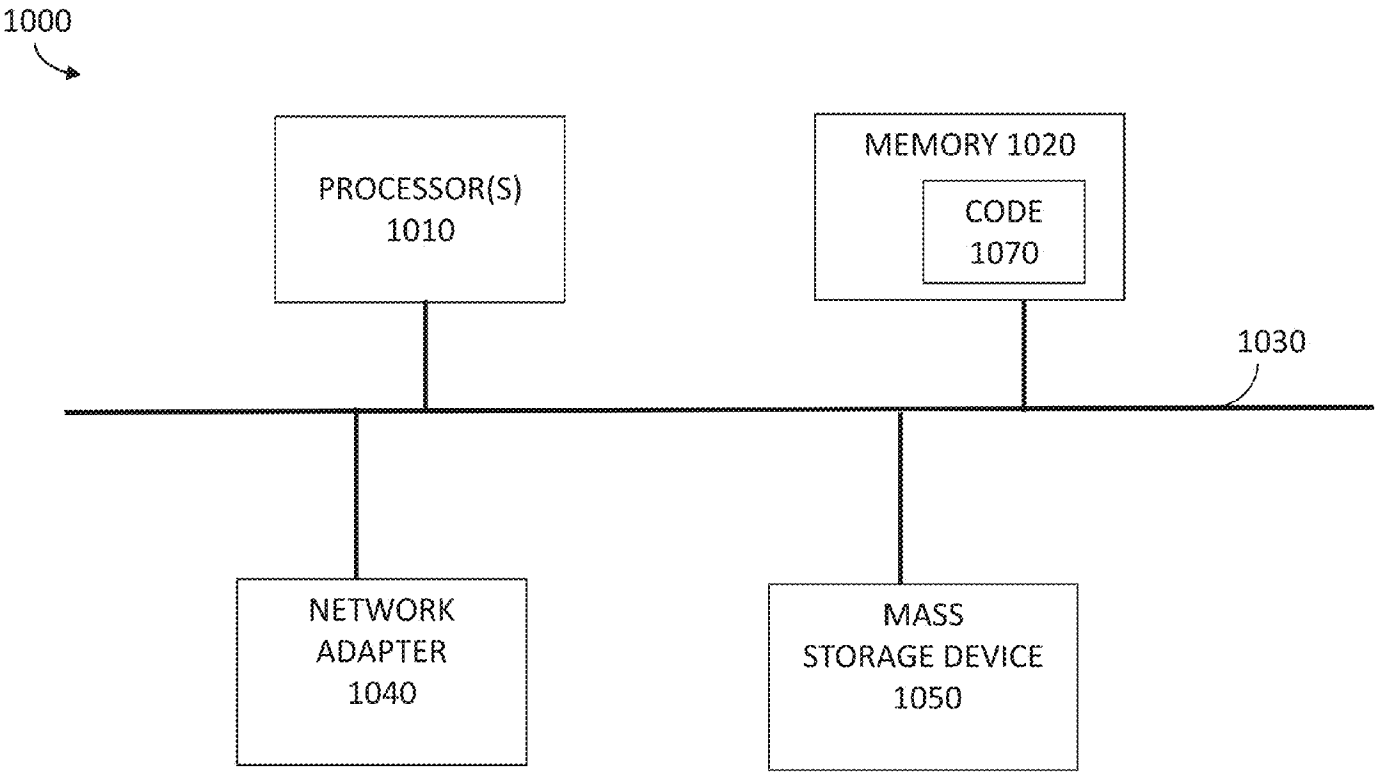
FIG. 10 is a high-level block diagram showing an example architecture of a computer, which may represent any electronic device, any server, or any node within a cloud service, as described herein.

FIG. 10 illustrates a high-level block diagram showing an example architecture of a computer 1000, which may represent any electronic device, such as a mobile device or a server, including any node within a cloud service as described herein, and which may implement the operations described above. The computer 1000 includes one or more processors 1010 and memory 1020 coupled to an interconnect 1030. The interconnect 1030 may be an abstraction that represents any one or more separate physical buses, point to point connections, or both connected by appropriate bridges, adapters, or controllers. The interconnect 1030, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire".

The processor(s) 1010 is/are the central processing unit (CPU) of the computer 1300 and, thus, control the overall operation of the computer 1000. In certain embodiments, the processor(s) 1010 accomplish this by executing software or firmware stored in memory 1020. The processor(s) 1010 may be, or may include, one or more programmable general-purpose or special-purpose microprocessors, digital signal processors (DSPs), programmable controllers, application specific integrated circuits (ASICs), programmable logic devices (PLDs), field-programmable gate arrays (FPGAs), trusted platform modules (TPMs), or a combination of such or similar devices.

The memory 1020 is or includes the main memory of the computer 1000. The memory 1020 represents any form of random access memory (RAM), read-only memory (ROM), flash memory, or the like, or a combination of such devices. In use, the memory 1020 may contain code 1070 containing instructions according to the techniques disclosed herein.

Also connected to the processor(s) 1010 through the interconnect 1030 are a network adapter 1040 and a mass storage device 1050. The network adapter 1040 provides the computer 1000 with the ability to communicate with remote devices over a network and may be, for example, an Ethernet adapter. The network adapter 1040 may also provide the computer 1000 with the ability to communicate with other computers.

The code 1070 stored in memory 1020 may be implemented as software and/or firmware to program the processor(s) 1010 to carry out actions described above. In certain embodiments, such software or firmware may be initially provided to the computer 1000 by downloading it from a remote system through the computer 1000 (e.g., via network adapter 1040).

CONCLUSION

The techniques introduced herein can be implemented by, for example, programmable circuitry (e.g., one or more microprocessors) programmed with software and/or firmware, or entirely in special-purpose hardwired circuitry, or in a combination of such forms. Software or firmware for use in implementing the techniques introduced here may be stored on a machine-readable storage medium and may be executed by one or more general-purpose or special-purpose programmable microprocessors.

In addition to the above mentioned examples, various other modifications and alterations of the invention may be made without departing from the invention. Accordingly, the above disclosure is not to be considered as limiting, and the appended claims are to be interpreted as encompassing the true spirit and the entire scope of the invention.

The various embodiments are described above with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

A "machine-readable storage medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible storage medium includes recordable/non-recordable media (e.g., read-only memory (ROM); random access memory (RAM); magnetic disk storage media; optical storage media; flash memory devices; etc.), etc.

These computer program instructions may also be stored in a computer readable medium that can direct a computer, other programmable data processing apparatus, or other devices to function in a particular manner, such that the instructions stored in the computer readable medium produce an object of manufacture including instructions which implement the function/act specified in the flowchart and/or block diagram block or blocks.

The computer program instructions may also be loaded onto a computer, other programmable data processing apparatuses, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The aforementioned flowchart and diagrams illustrate the architecture, functionality, and operation of possible implementations of systems, methods and computer program products according to various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

We claim:

1. A system, comprising:

a drumstick state module that measures a state of motion of a drumstick relative to a virtual strike location for a virtual strike of a virtual drum to be performed by the drumstick;

a strike prediction module that determines a predicted time at which the drumstick arrives at the virtual strike location for the virtual strike of the virtual drum based on the measured state of motion of the drumstick; and an action module that performs an action associated with a drumstick striking a real drum upon commencement of the determined predicted time, and a haptic feedback module synchronized with the strike prediction module to provide haptic feedback to a user at the predicted time at which the drumstick arrives at the virtual strike location.

2. The system of claim 1, wherein the strike prediction module:

measures, from the identified state of motion of the drumstick relative to the virtual strike location, a current acceleration and trajectory of the drumstick within three-dimensional space with respect to the virtual strike location of the virtual drum; and determines the predicted time as a time at which a tip portion of the drum stick is expected to arrive at the virtual strike location based on the measured acceleration and trajectory of the drumstick with respect to the virtual strike location.

3. The system of claim 1, wherein the strike prediction module determines the predicted time as a time at which the predicted state of motion of the drumstick is associated with the drumstick decelerating to approximately zero acceleration proximate to the virtual strike location of the virtual drum.

4. The system of claim 1, wherein the strike prediction module determines the predicted time as a time at which a trajectory of the drumstick within three-dimensional space with respect to the virtual strike location of the virtual drum is predicted to change from a first direction towards the virtual strike location of the virtual drum to a second direction away from the virtual strike location of the virtual drum.

5. The system of claim 1, wherein the drumstick state module and the strike prediction module are located within the drumstick, and wherein the action module is located within a mobile application supported by a mobile device associated with a user of the drumstick, the system further comprising:

a communication module that communicates a message whose contents include information representing the determined predicted time and information representing the identified state of motion of the drumstick from the strike prediction module to the action module.

6. The system of claim 1, wherein the drumstick state module and the strike prediction module are part of a motion detection device that captures images of the motion of the drumstick, and wherein the action module is located within a mobile application supported by a mobile device associated with a user of the drumstick, the system further comprising:

a communication module that communicates a message whose contents include information representing the determined predicted time and information representing the identified state of motion of the drumstick from the strike prediction module to the action module.

7. The system of claim 1, further comprising:

a communication module that communicates a message from the strike prediction module to the action module before a tip portion of the drum stick arrives at the virtual strike location of the virtual drum, the message including information representing the determined predicted time and information representing the identified state of motion of the drumstick.

8. The system of claim 1, wherein the action module causes an audio presentation device associated with a user of the drumstick to play a sound indicative of the drumstick striking the real drum associated with the virtual drum at the virtual drum location.

9. The system of claim 1, wherein the action module causes an audio presentation device associated with a user of the drumstick to play a sound that is based on the real drum associated with the virtual drum at the virtual drum location and a measured strike force applied from the drumstick to the virtual drum during the virtual strike.

10. A method, comprising:

measuring a state of motion of a striking object relative to a virtual strike location for a virtual strike of a virtual percussion instrument to be performed by the striking object;

determining a predicted time at which the striking object arrives at the virtual strike location for the virtual strike of the virtual percussion instrument based on the measured state of motion of the striking object; and performing an action associated with the striking object striking a real percussion instrument upon commencement of the determined predicted time; and providing to a user, haptic feedback synchronized with the strike prediction module at the predicted time at which the drumstick arrives at the virtual strike location.

11. The method of claim 10, wherein determining a predicted time at which the striking object arrives at the virtual strike location for the virtual strike of the virtual percussion instrument based on the measured state of motion of the striking object includes:

measuring, from the identified state of motion of the striking object relative to the virtual strike location, a current acceleration and trajectory of the striking object within three-dimensional space with respect to the virtual strike location of the virtual percussion instrument; and determining the predicted time as a time at which a strike portion of the striking object is expected to arrive at the virtual strike location based on the measured acceleration and trajectory of the striking object with respect to the virtual strike location.

12. The method of claim 10, wherein determining a predicted time at which the striking object arrives at the virtual strike location for the virtual strike of the virtual percussion instrument based on the measured state of motion of the striking object includes determining the predicted time as a time at which the predicted state of motion of the striking object is associated with the striking object decelerating to approximately zero acceleration when proximate to the virtual strike location of the virtual percussion instrument.

13. The method of claim 10, wherein determining a predicted time at which the striking object arrives at the virtual strike location for the virtual strike of the virtual percussion instrument based on the measured state of motion of the striking object includes determining the predicted time as a time at which a trajectory of the striking object within three-dimensional space with respect to the virtual strike location of the virtual percussion instrument is predicted to change from a first direction towards the virtual strike location of the virtual percussion instrument to a second direction away from the virtual strike location of the virtual percussion instrument.

14. The method of claim 10, wherein performing an action associated with a striking object striking a real percussion instrument upon commencement of the determined predicted time includes causing an audio presentation device associated with a user of the striking object to play a sound indicative of a drumstick striking a drum or cymbal.

15. The method of claim 10, wherein performing an action associated with a striking object striking a real percussion instrument upon commencement of the determined predicted time includes causing an audio presentation device associated with a user of the striking object to play a sound indicative of a foot pedal striking a drum or engaging a cymbal.

16. A non-transitory computer-readable medium whose contents, when executed by a computing system, cause the computing system to perform operations for generating an audio sequence based on a monitored movement of drumsticks with respect to virtual drum locations, the operations comprising:

monitoring movement of the drumsticks relative to the virtual drum locations;

determining predicted times of virtual strikes performed by the drumsticks at the virtual drum locations; and generating an audio sequence that includes sounds to be played upon commencement of the determined predicted times of the virtual strikes at the virtual drum locations; and providing to a user, haptic feedback synchronized with the strike prediction module at the predicted time at which the drumstick arrives at the virtual strike location.

17. The non-transitory computer-readable medium of claim 16, wherein determining predicted times of virtual strikes performed by the drumsticks at the virtual drum locations includes, for each virtual strike performed by a drumstick at a virtual drum location:

determining a state of motion of the drumstick relative to the virtual drum location, wherein the state of motion is based on a measured acceleration of the drumstick and a measured trajectory of the drumstick within three-dimensional space with respect to the virtual drum location; and determining a predicted time of a virtual strike performed by the drumstick at the virtual drum location based on the determined state of motion of the drumstick relative to the virtual drum location.

18. The non-transitory computer-readable medium of claim 16, wherein monitoring movement of the drumsticks relative to the virtual drum locations includes measuring movement of the drumsticks using one or more accelerometers or gyroscopes contained within the drumsticks.

19. The non-transitory computer-readable medium of claim 16, wherein monitoring movement of the drumsticks relative to the virtual drum locations includes:

visually capturing movement of the drumsticks using one or more image sensors; and extracting information associated with acceleration of the drumstick and a trajectory of the drumstick within three-dimensional space from images captures by the one or more image sensors.

20. The non-transitory computer-readable medium of claim 16, wherein generating an audio sequence that includes sounds to be played upon commencement of the determined predicted times of the virtual strikes at the virtual drum locations includes generating, for every virtual strike at a virtual drum location, a sound that is based on a specific virtual drum associated with the virtual drum location and a measured strike force applied from the drumstick to the specific virtual drum during the virtual strike.

21. A method, comprising:

measuring a state of motion of a wand relative to a virtual strike location for a virtual strike of a virtual object performed by the striking wand;

determining a predicted time at which the wand arrives at the virtual strike location for the virtual strike of the virtual object based on the measured state of motion of the wand; and performing an action associated with the wand striking a real object upon commencement of the determined predicted time: and providing to a user, haptic feedback synchronized with the strike prediction module at the predicted time at which the drumstick arrives at the virtual strike location.

22. The method of claim 21, wherein determining a predicted time at which the wand arrives at the virtual strike location for the virtual strike of the virtual object based on the measured state of motion of the wand includes:

measuring, from the identified state of motion of the wand relative to the virtual strike location, a current acceleration and trajectory of the wand within three-dimensional space with respect to the virtual strike location of the virtual object; and determining the predicted time as a time at which a strike portion of the wand is expected to arrive at the virtual strike location based on the measured acceleration and trajectory of the wand with respect to the virtual strike location.

23. The method of claim 21, wherein determining a predicted time at which the wand arrives at the virtual strike location for the virtual strike of the virtual object based on the measured state of motion of the wand includes determining the predicted time as a time at which the predicted state of motion of the wand is associated with the wand decelerating to approximately zero acceleration when proximate to the virtual strike location of the virtual object.

24. The method of claim 21, wherein determining a predicted time at which the wand arrives at the virtual strike location for the virtual strike of the virtual object based on the measured state of motion of the wand includes determining the predicted time as a time at which a trajectory of the wand within three-dimensional space with respect to the virtual strike location of the virtual object is predicted to change from a first direction towards the virtual strike location of the virtual object to a second direction away from the virtual strike location of the virtual object.

* * * * *